US006273506B1

(12) United States Patent
Niergarth et al.

(10) Patent No.: US 6,273,506 B1
(45) Date of Patent: Aug. 14, 2001

(54) CHAIR WITH AN ADJUSTABLE SEAT

(75) Inventors: Tom S Niergarth, Holland; Graham J. Britain, Wolverine Lake; Ed Sudduth, Livonia, all of MI (US); Richard Holbrook, Pasadena, CA (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 09/041,186

(22) Filed: Mar. 10, 1998

Related U.S. Application Data

(62) Division of application No. 08/481,734, filed on Jun. 7, 1995, now Pat. No. 5,765,914.

(51) Int. Cl.[7] ..... A47C 1/024

(52) U.S. Cl. ..... 297/300.4; 297/300.8; 297/303.3

(58) Field of Search ..... 297/300.4, 300.7, 297/300.8, 302.3, 303.3, 344.1; 248/424, 429

(56) References Cited

U.S. PATENT DOCUMENTS

| | | | | |
|---|---|---|---|---|
| 1,927,491 | | 9/1933 | Gabb | 155/157 |
| 2,271,925 | | 2/1942 | Niles . | |
| 2,272,980 | | 2/1942 | McLellan et al. | 155/77 |
| 2,307,621 | | 1/1943 | Dorton | 15/161 |
| 2,313,023 | | 3/1943 | Ruegger et al. | 155/116 |
| 2,369,580 | | 2/1945 | Koenig | 155/94 |
| 3,057,660 | | 10/1962 | Schneider . | |
| 3,224,807 | | 12/1965 | Welch et al. | 297/304 |
| 3,232,574 | | 2/1966 | Ferro | 248/379 |
| 3,235,308 | | 2/1966 | Conner . | |
| 3,351,379 | | 11/1967 | Street | 297/358 |
| 3,982,785 | | 9/1976 | Ambasz . | |
| 4,084,850 | | 4/1978 | Ambasz . | |
| 4,102,549 | | 7/1978 | Morrison et al. | 297/383 |
| 4,210,303 | * | 7/1980 | Torta et al. | 248/429 |
| 4,240,663 | | 12/1980 | Locher . | |
| 4,333,683 | | 6/1982 | Ambasz . | |
| 4,334,709 | | 6/1982 | Akiyama et al. . | |
| 4,384,741 | * | 5/1983 | Flum et al. | 297/304 |
| 4,438,898 | * | 3/1984 | Knoblauch et al. | 297/303.3 X |
| 4,536,031 | | 8/1985 | Latone | 297/353 |
| 4,537,445 | * | 8/1985 | Neuhoff | 297/300.8 X |
| 4,541,669 | | 9/1985 | Goldner . | |
| 4,565,344 | * | 1/1986 | Iwami | 248/429 |
| 4,629,249 | | 12/1986 | Yamaguchi . | |
| 4,640,548 | * | 2/1987 | Desanta | 297/300.8 X |
| 4,709,962 | | 12/1987 | Steinmann . | |
| 4,768,829 | | 9/1988 | Goldman . | |
| 4,773,703 | | 9/1988 | Krugener et al. . | |
| 4,790,600 | | 12/1988 | Behringer . | |
| 4,795,212 | | 1/1989 | Bailey et al. | 297/362 |
| 4,861,106 | | 8/1989 | Sondergeld | 297/316 |

(List continued on next page.)

FOREIGN PATENT DOCUMENTS

| | | |
|---|---|---|
| 631285 | 12/1927 | (FR) . |
| 5254 | 4/1900 | (GB) . |
| 23621 | 7/1915 | (GB) . |
| 1346420 | 2/1974 | (GB) . |
| WO 92/19132 | 11/1992 | (WO) . |

OTHER PUBLICATIONS

Brochure. HÅg Signét Collection: office, reception and conference chairs, Design by Svein Asbjornsen and Partners.

Brochure. HÅg Scio Collection: office chairs, Design by Soren Yran.

*Primary Examiner*—Peter M. Cuomo
*Assistant Examiner*—Stephen Vu
(74) *Attorney, Agent, or Firm*—Brinks Hofer Gilson & Lione

(57) ABSTRACT

A chair includes a base, a backrest supported by the base, a seat support by the base, and a seat slidably mounted to the seat support. A seat adjustment device can be employed to allow for forward and rearward adjustment of the seat relative to the backrest.

68 Claims, 15 Drawing Sheets

U.S. PATENT DOCUMENTS

| | | | | |
|---|---|---|---|---|
| 4,915,447 | | 4/1990 | Shovar . | |
| 4,943,115 | * | 7/1990 | Stucki | 297/300.4 |
| 4,981,326 | | 1/1991 | Heidmann . | |
| 4,984,846 | | 1/1991 | Ekornes . | |
| 5,009,466 | | 4/1991 | Perry . | |
| 5,024,484 | | 6/1991 | Buchacz | 297/300 |
| 5,035,466 | | 7/1991 | Mathews et al. . | |
| 5,076,529 | * | 12/1991 | Dove et al. | 248/429 |
| 5,100,092 | * | 3/1992 | Sovis | 248/429 |
| 5,120,109 | | 6/1992 | Rangoni . | |
| 5,171,062 | | 12/1992 | Courtois . | |
| 5,222,783 | | 6/1993 | Lai . | |
| 5,366,272 | | 11/1994 | Lebrun . | |
| 5,380,063 | | 1/1995 | Dauphin . | |
| 5,405,188 | | 4/1995 | Hanson . | |
| 5,425,522 | * | 6/1995 | Retzlaff | 248/429 |
| 5,447,357 | | 9/1995 | Dauphin . | |
| 5,499,861 | | 3/1996 | Locher . | |
| 5,511,852 | | 4/1996 | Kusiak et al. . | |
| 5,536,067 | | 7/1996 | Pinto . | |
| 5,556,163 | | 9/1996 | Rogers, III et al. . | |
| 5,597,203 | | 1/1997 | Hubbard . | |
| 5,630,647 | | 5/1997 | Heidmann et al. . | |
| 5,647,635 | | 7/1997 | Aumond et al. . | |
| 5,683,139 | * | 11/1997 | Golynsky et al. | 297/300.4 X |
| 5,785,387 | * | 7/1999 | Hernandez et al. | 248/429 X |
| 5,810,439 | * | 9/1998 | Roslund, Jr. | 297/300.4 |
| 5,813,726 | * | 9/1998 | Husted | 248/429 X |
| 5,871,258 | | 2/1999 | Battey et al. . | |
| 5,918,846 | * | 7/1999 | Garrido | 248/429 |

* cited by examiner

CHAIR WITH AN ADJUSTABLE SEAT

CROSS-REFERENCE TO RELATED APPLICATIONS

This application is a division of U.S. application Ser. No. 08/481,734, filed Jun. 7, 1995, now issued as U.S. Pat. No. 5,765,914, which application is hereby incorporated by reference herein.

BACKGROUND OF THE INVENTION

The present invention relates generally to tilt control mechanisms for chairs, and in particular, to synchrotilt control mechanisms.

In general, tilt control mechanisms are mechanical devices that control the tilting of a chair when occupied by a user. To provide improved aesthetics, and to avoid interference with use of the chair, tilt control mechanisms are typically mounted underneath the chair. Tilt control mechanisms also typically employ a spring, or other energy storing device, to control the rate at which the chair tilts and to return the chair to an upright position when the user is not leaning back in it. Tilt control mechanisms generally include an adjustment device that permits the user to vary the upward force exerted by the spring, thereby allowing the chair to tilt downwardly and rearwardly more or less easily depending on the upward force exerted.

Tilt chairs come in a variety of forms, although most include a seat and a back. For example, some tilt chairs have a seat maintained in a fixed position, allowing only the back to tilt rearwardly and downwardly. In another form, tilt chairs have the seat and back rigidly connected whereby they tilt rearwardly and downwardly at the same rate. Both of these types of chairs have disadvantages. For example, a fixed seat and back arrangement does not allow the user's body cavity to open up as the user tilts rearwardly. An open body cavity allows for better circulation and spinal curvature, thereby improving the user's comfort and physical health. Moreover, many of the previous designs pivot about a point near the base or support of the chair where the user's center of gravity is located. As a result, when the chair is tilted rearwardly, the user's feet are lifted off of the floor by the front part of the seat, thereby generating pressure on the underside of the user's thighs, making the user uncomfortable and inhibiting the user's circulation. Synchrotilt control mechanisms were designed to overcome some of these problems.

With synchrotilt mechanisms, the back and seat tilt simultaneously, but at different rates. Generally, the back tilts at a faster rate than the seat so that the body cavity opens. An example of a prior synchronous tilt control mechanism may be found in U.S. Pat. No. 4,390,206, entitled Synchrotilt Chair Control and issued to Faiks, et. al.

Typically, synchrotilt chairs have the seat and back interconnected so as to actuate the synchronized tilting of the back with the seat. For example, the seat and back may be directly pivotally connected as set forth in the Faiks, et. al. Patent. Other synchrotilt control mechanisms employ linkage mechanisms to interconnect the seat and back and to actuate the synchronous tilting. In either type, the synchrotilt control mechanism comprises complex interconnecting moving parts. The majority of these prior art tilt control mechanisms permit only backward tilting of the chair, separately or together at differing rates. To counter that problem, U.S. Pat. No. 5,029,940, entitled Chair Tilt and Chair Height Control Apparatus and issued to Golynsky, discloses a tilt mechanism permitting both forward and backward tilting of the chair seat and back using the same mechanism. That mechanism uses a four-bar linkage mechanism, whereby the seat is interconnected with the back. When the seat is tilted upwardly, the back of the chair is also caused to be tilted upwardly. Accordingly, the back can protrude into the user's back thus making use in the forward tilt position uncomfortable.

SUMMARY OF THE INVENTION

Briefly stated, the invention is directed to a chair adapted for synchronous tilting between an upright position and a reclined position. In one aspect, the chair has a base, a tilt control housing, a seat, a back, a torsion spring, a first slide member, a second slide member and a tilt limiter device. The tilt control housing is mounted to-the base. The seat is pivotally attached to the tilt control housing about a first horizontal axis. The back is pivotally attached to the tilt control housing about a second horizontal axis positioned rearwardly of the first horizontal axis. The back includes a forwardly extending support member. The torsion spring has a forwardly extending leg mounted to the tilt control housing and a rearwardly extending leg. The first slide member is disposed on one of the seat and support member and slidably engages the other of the seat and support member. The second slide member is disposed on one of the support member and the rearwardly extending leg of the torsion spring and engages the other of the support member and rearwardly extending leg. The tilt limiter device is adapted to limit upward tilting of the back.

Another aspect of the invention is to provide a tilt lock device to releasably lock the chair in a plurality of positions, including an upright position and a reclined position. The tilt lock device includes a lock member, a guide member having a guide hole and a lock pin slidably received in the guide hole. The lock member has a plurality of openings adapted to receive the lock pin and extends downwardly from the back support member. The guide member is mounted to the tilt control housing. When the tilt lock device is activated, the lock pin selectively engages the lock member at one of the openings.

In another aspect of the invention, the chair is adapted to permit a forward tilting of the seat without a corresponding forward tilting of the back. In a preferred embodiment, the seat can be maintained in the forward position by securing the seat with a stop device. Because the seat is not linked to the back, but only slidably engages it by way of the first slide member, the forward tilting of the seat does not simultaneously cause a forward tilting of the back. The back, therefore, does not protrude into the user's back or otherwise interfere with the space located above the forwardly tilted seat.

Another aspect is for the horizontal axis of the torsion spring to be spaced apart from the second horizontal axis of rotation. Preferably, the axis of the spring is positioned below the second axis of rotation of the back such that the torsion spring exerts an increasingly greater upward force to counter any shift in the center of gravity of the user as the chair tilts rearwardly.

Yet another aspect of the invention is a seat depth mechanism, which permits the user to adjust the forward and rearward position of the seat with respect to the back of the chair. The mechanism includes a shell slidably attached to a seat bracket, a lever, a spring and a fastener. The shell includes a housing. The seat bracket has an adjustment slot and a plurality of teeth. The lever is disposed in the housing and is adapted to operably engage the spring which is also disposed in the housing. The lever is also adapted to engage the teeth of the seat bracket. When the lever is disengaged from the teeth, the user can slide the shell forward and rearward on the seat bracket until a desired positioning of the shell is achieved. When the lever is released by the user, the spring biases the lever inwardly to engage the teeth of the seat bracket, thereby preventing the shell from sliding in the forward or rearward direction.

The present invention provides significant advantages over other synchronous tilt mechanisms in that the synchronous tilt mechanism is simplified by using two slide members without the need for a complicated linkage mechanism. Furthermore, the tilt mechanism provides a device for locking the back and seat in a variety of positions. Finally, the simplified slide mechanism permits the seat of the chair to tilt forwardly and upwardly without the corresponding forward tilt of the back.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
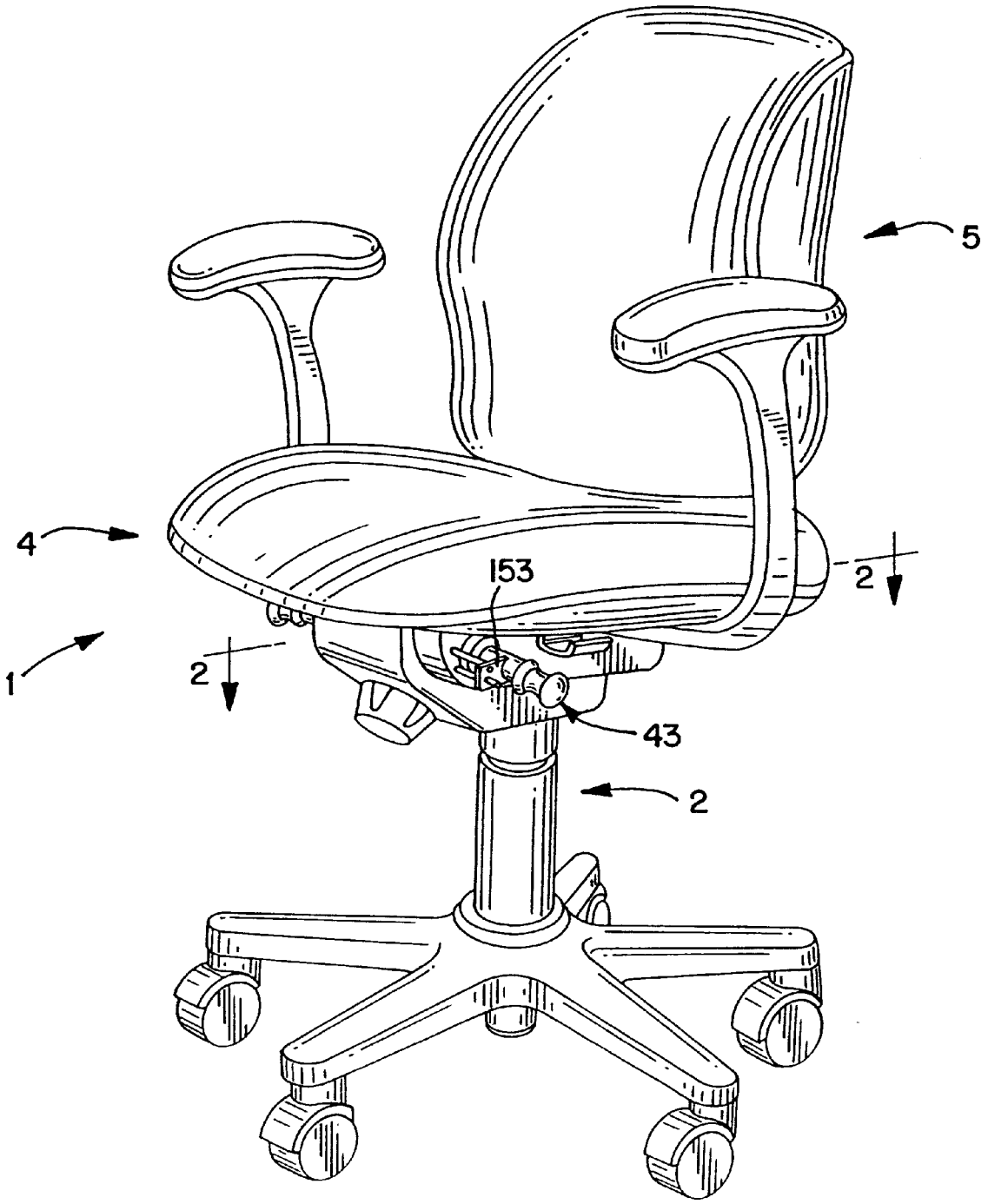
FIG. 1 is a perspective view of an office chair with the tilt control mechanism applied thereto.
Figure 2:
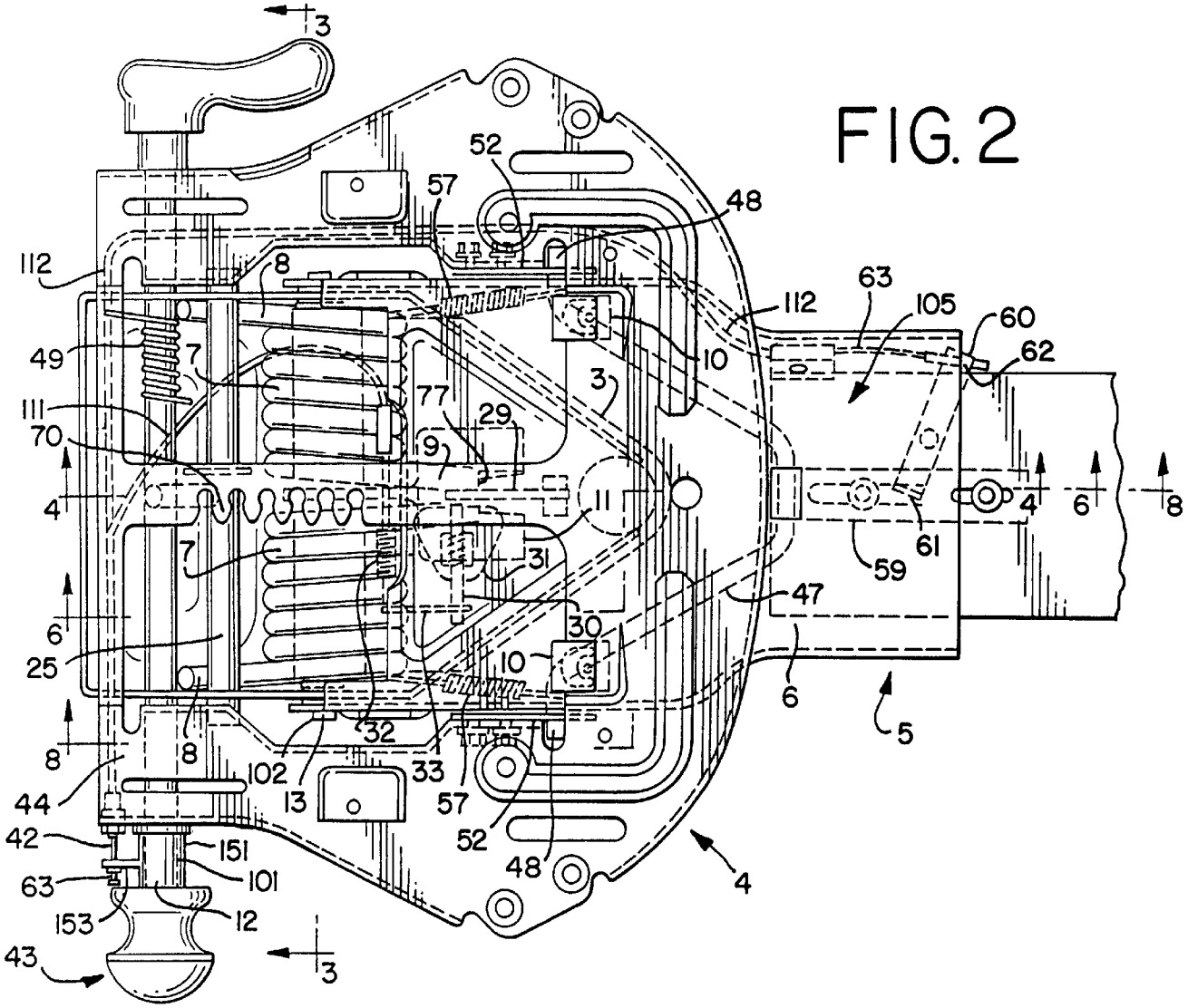
FIG. 2 is a top view of an office chair taken along line 2—2 of FIG. 1 with a preferred embodiment of the tilt control mechanism applied thereto, including a tilt lock device and a seat lock device.
Figure 3:
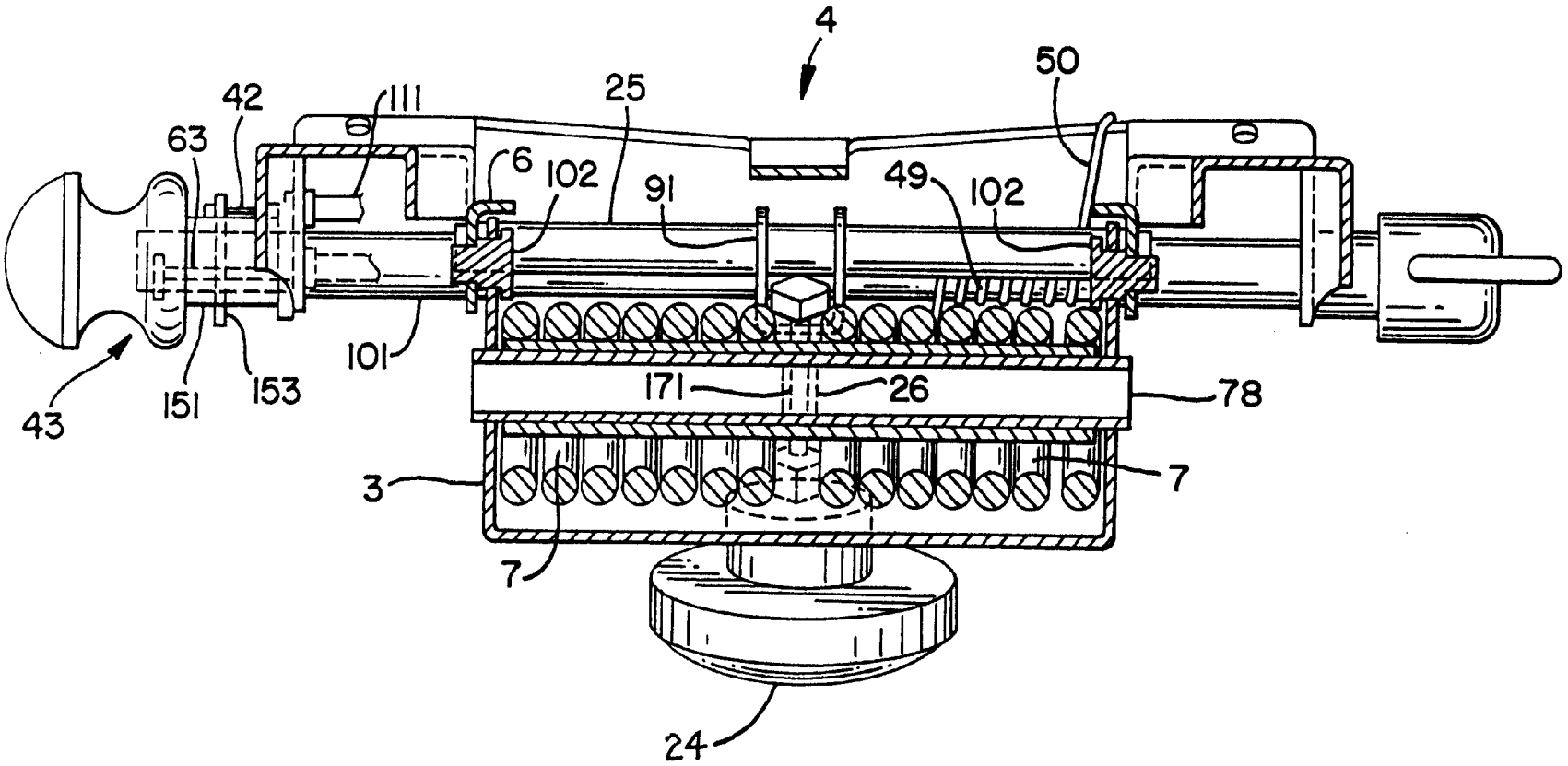
FIG. 3 is a cross-sectional view of the tilt control mechanism taken along line 3—3 of FIG. 2.
Figure 4:
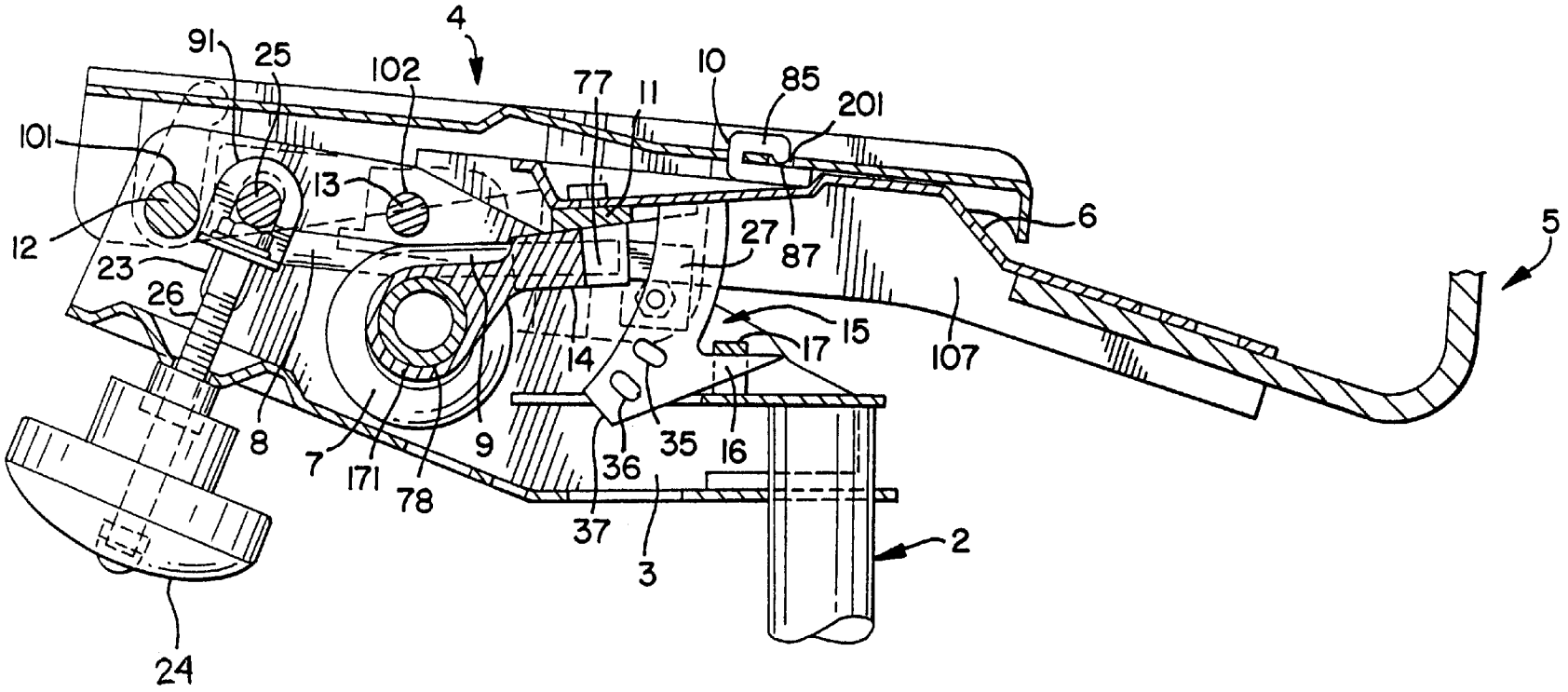
FIG. 4 is a cross-sectional view of the chair in an upright position taken along line 4—4 of FIG. 2 except that a coupling block is shown instead of the seat lock device.
Figure 6:
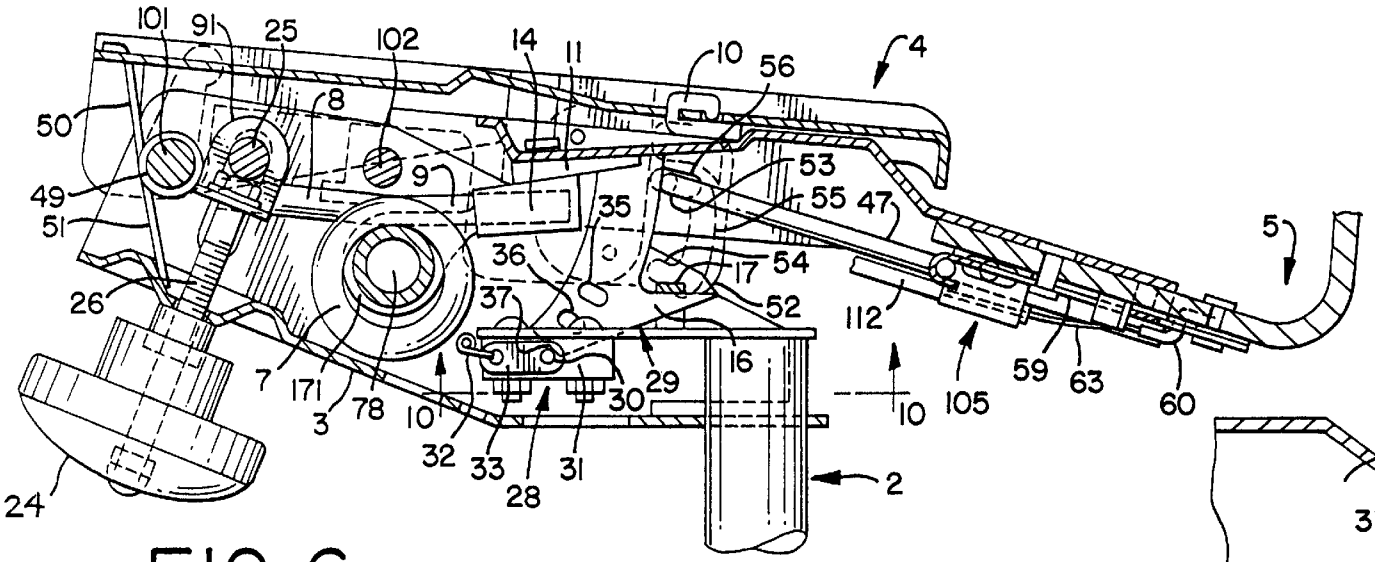
FIG. 6 is a cross-sectional view of the tilt control mechanism taken along line 6—6 of FIG. 2 with the chair located in an upright position.

Referring to the drawings, FIGS. 1, 2, 4 and 6 show a synchronous tilt chair 1 including a base 2, a seat 4, a back 5, a torsion spring 7, a first slide member 10, and a second slide member 11. Mounted to the base 2 is a tilt control housing 3. The seat 4 is pivotally attached to the tilt control housing 3 using a first pivot member 101. The back 5 is pivotally attached to the tilt control housing 3 using a pair of second pivot members 102, as shown in FIGS. 2 and 3. The seat 4 rotates about a first axis of rotation 12 and the back 5 rotates about a second axis of rotation 13. The first and second axis of rotation 12 and 13 are generally parallel. In a preferred embodiment, the first axis of rotation 12 is positioned forward of the second axis 13 as shown in FIGS. 2, 4 and 6 so as to provide for synchronous tilting of the seat and the back.

Figure 15:
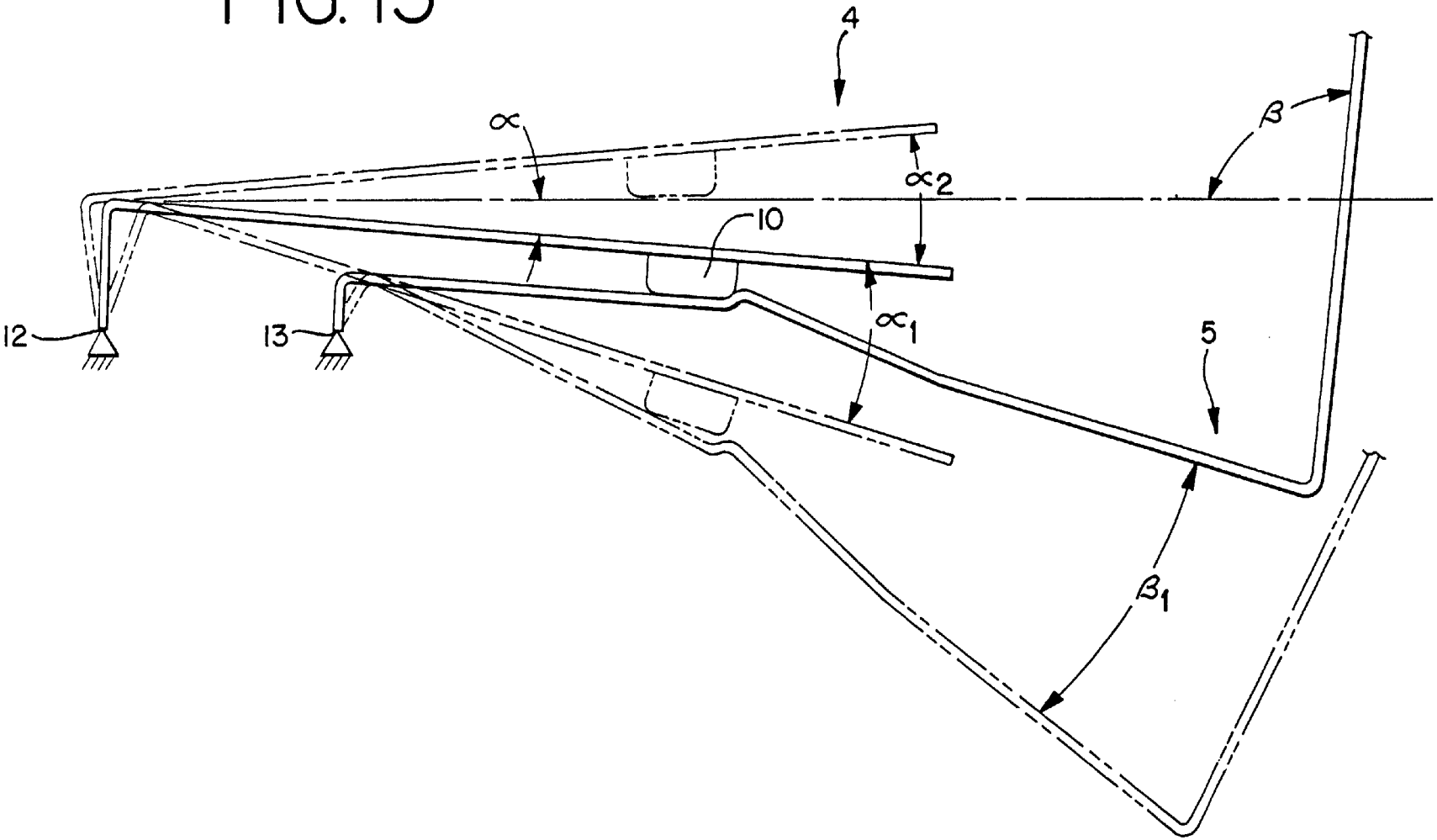
FIG. 15 is a schematic showing the relative positioning of the back and seat in a reclined position, an upright position and a forward tilt position.

As shown in the FIG. 15 schematic, the seat 4 is positioned relative to a horizontal plane at an angle designated by the Greek letter alpha ($\alpha$) when the chair is in an upright position. Similarly, the back 5 is positioned relative to the horizontal plane at an angle designated by the Greek letter beta ($\beta$). In a preferred embodiment, $\alpha$ is about five degrees and $\beta$ is about ninety-five degrees. When the first axis of rotation 12 is positioned forward of the second axis of rotation 13, the seat 4 rotates through a first angle, designated as $\alpha 1$, as the back 5 rotates through a greater second angle, designated as $\beta 1$. In a preferred embodiment, $\alpha 1$ is about 12.5 degrees and $\beta 1$ is about 20.5 degrees, thereby providing a 1.64:1 tilt ratio. It should be understood that a change in position of the first axis of rotation relative to the second axis of rotation will correspondingly change the tilt ratio. A tilt ratio in the range of about 1.5:1 to 2.0:1 will generally provide a comfortable tilting action for a user. The synchronous tilting of the seat 4 and back 5 permits the user's body cavity to open as the user tilts rearwardly and thereby contributes to the increased comfort of the user.

As shown in FIGS. 2, 4 and 6, the back 5 generally includes a forwardly extending support member 6 positioned below the seat 5. In a preferred embodiment, shown in FIG. 4, a first slide member 10 is fixedly mounted to the seat 4 and slidably engages the support member 6. In the preferred embodiment, the first slide member 10 has an arm 85 and a tab 87. The arm 85 wraps around an edge 89 of the seat 4 and the tab 87 is disposed in a hole 91 in the seat 4. The arm 85 can be lifted upwardly so as to disengage the tab 87 from the seat 4, whereby the first slide member 10 can be removed and replaced easily and inexpensively.

Figure 4A:
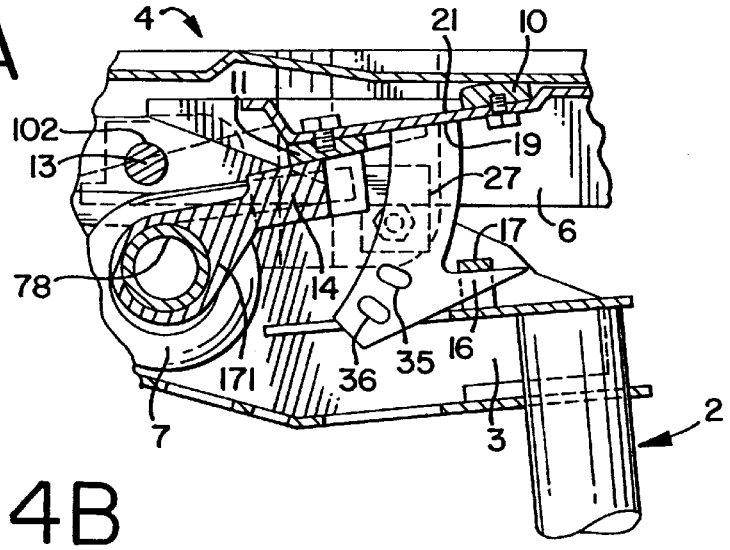
FIG. 4A is a partial sectional view similar to FIG. 4 except that the first slide member is disposed on the back support member.

In alternative embodiments, the first slide member can be made an integral part of the seat or support member, or it can be a separate member, but more permanently mounted, such as by bonding. As shown in FIGS. 4A and 48, the first slide member 10 can also be mounted on a top surface 21 of the support member 6 and adapted to slidably engage the seat 4.

It is recognized that one or more first slide members 10 may be used to support and slidably engage the seat 4 and support member 6. For example, the preferred embodiment shown in FIG. 2 employs a pair of first slide members 10. By using a pair of first slide members 10, the contact surface area between the first slide members 10 and the seat 4 and support member 6 is greatly increased, thereby distributing the load more evenly between the seat 4 and support member 6 and reducing large point loads and resulting stresses in the seat 4 and support member 6. In a preferred embodiment, the first slide members 10 are made out of acetal. Hoechst Celanese produces a commercially available acetal material designated M90 CELCON. Acetal exhibits excellent wear characteristics, yet provides a good sliding interface with the seat or support member, which are preferably made out of steel.

As shown in FIGS. 2 and 3, a pair of torsion springs 7 is used to support the seat 4 and back 5. The springs 7 are disposed on a shaft 78. Each torsion spring 7 has a forwardly extending leg 8 adjustably mounted to the tilt control housing 3 as shown in FIGS. 4 and 6. Each torsion spring 7 also has a rearwardly extending leg 9 which slidably engages a second slide member 11.

Figure 5:
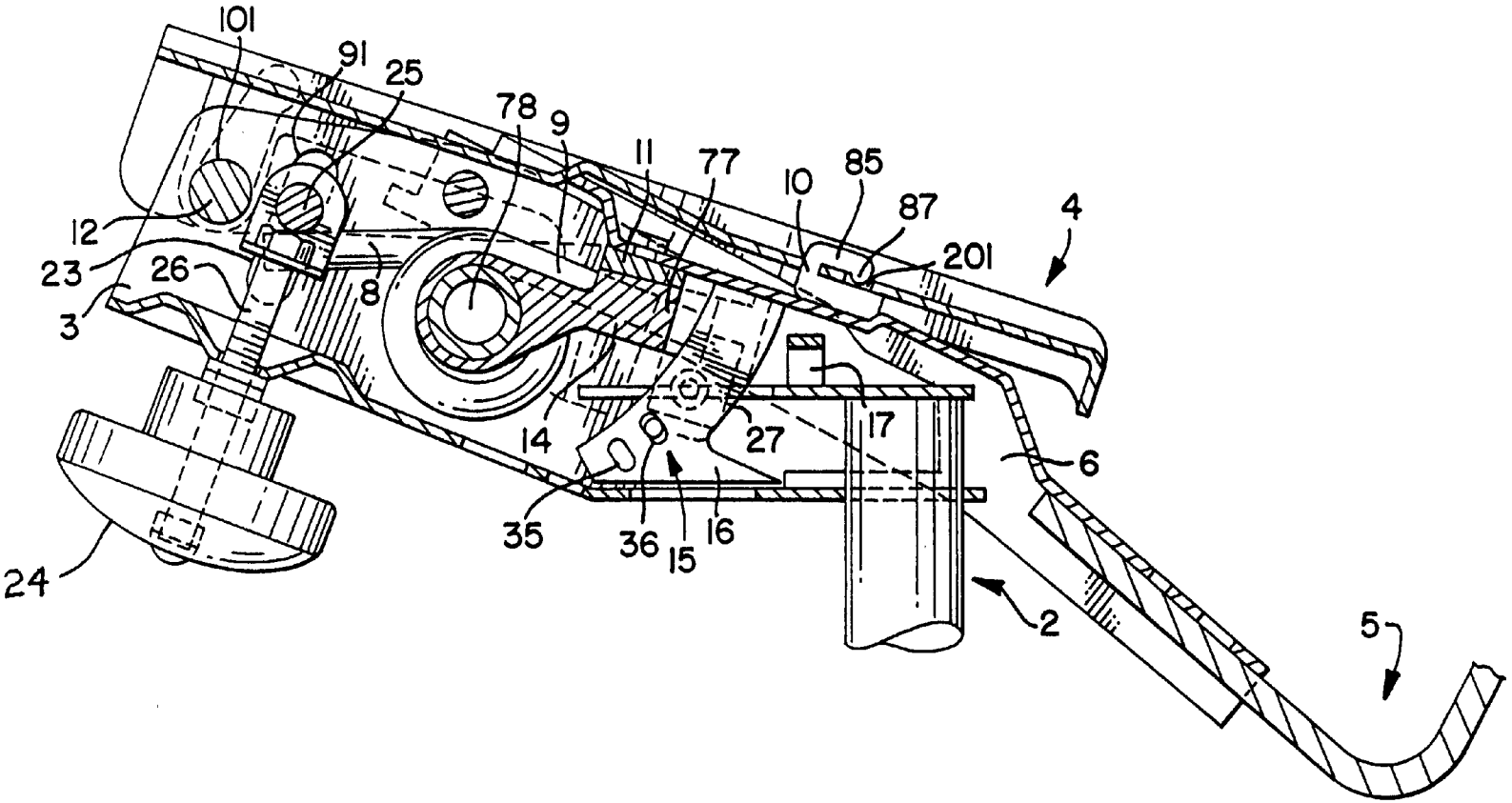
FIG. 5 is a cross-sectional view of the tilt control mechanism similar to FIG. 4 except that the chair is located in a reclined position.

To accommodate the various weights of different users, an adjustment knob 15 can be used to vary the amount of upward force exerted by the torsion springs 7. For example, the adjustment knob 15 can tighten the torsion springs 7 by operably engaging and forcing downward an adjustment bar 25. The adjustment bar 25 is positioned in guide slots 23 located in the tilt control housing 3 as shown in FIGS. 4 and 5. The adjustment bar 25 engages the forwardly extending legs 8 of the torsion springs 7. When tightened, the adjustment knob 24 operably engages a screw 26 extending upwardly from the adjustment knob 24. The adjustment knob 24 is adapted to receive the screw 26 as it moves downwardly. The screw 26 is mounted to an adjustment bracket 91 which engages the adjustment bar 25. As the adjustment knob 24 turns the screw, causing it to move downwardly within a hole located in the adjustment knob 24, the adjustment bar 25 moves downwardly in the guide slots 23, thereby increasing the torque of the torsion springs 7. Correspondingly, a greater upward force is exerted by the ends of the rearwardly extending legs 9 of the torsion springs 7 against the second slide member 11. In this way, the user can adjust the amount of upward force exerted against the seat 4 and user. If it is desirable to have a greater force exerted, i.e., to accommodate heavier users, the adjustment knob 24 provides a simple way of varying the resistant upward force. A wide variety of user weights may therefore be accommodated. Similarly, if a user wishes to have greater or lesser spring resistance in order to give a firmer or softer feel to the chair, respectively, they can adjust the torsion spring accordingly.

Figure 4B:
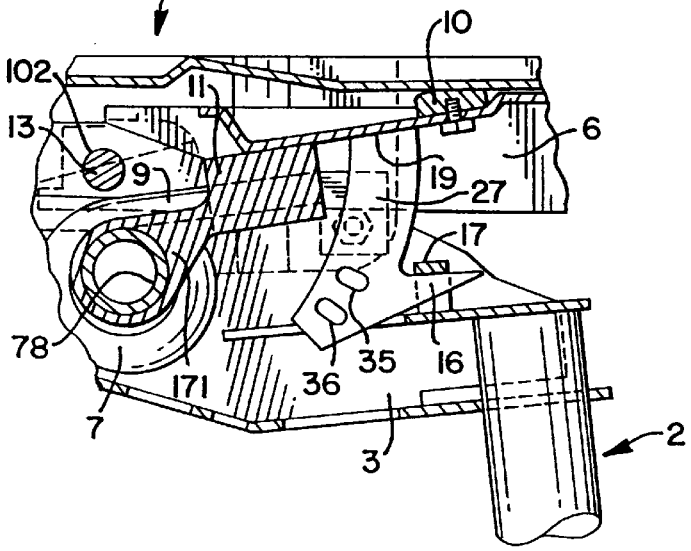
FIG. 4B is a partial sectional view similar to FIG. 4A except that the second slide member is disposed on the rearwardly extending leg of the torsion spring.
Figure 4C:
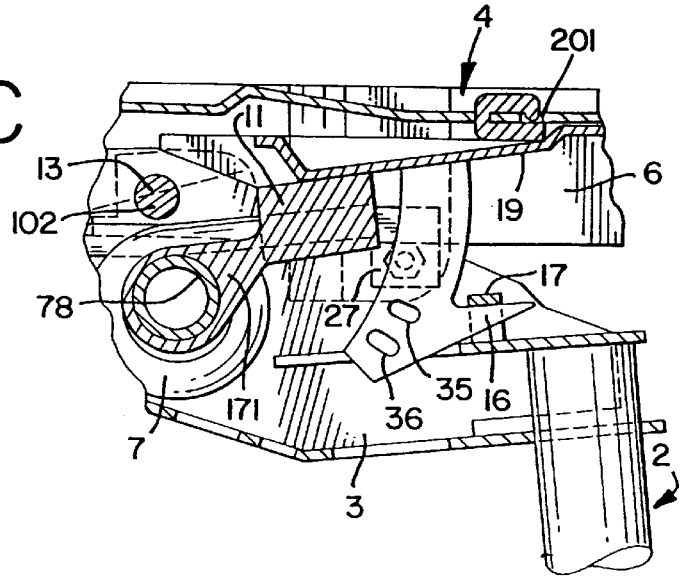
FIG. 4C is a partial sectional view similar to FIG. 4 except that the second slide member is disposed on the rearwardly extending leg of the torsion spring.

Preferably, the second slide member 11 is disposed on the underside 19 of the support member 6 and slidably engages the rearwardly extending legs 9 of the torsion springs 7 which have end portions 77 coupled together by a block member 14, as shown in FIG. 4. Alternatively, the second slide member can slidably engage the rearwardly extending legs without a block member interposed between the slide member and legs. In another embodiment, the second slide member 11 is disposed on the rearwardly extending legs 9 of the torsion springs 7 and slidably engages, as illustrated in FIGS. 4B and 4C, the underside 19 of the support member 6. In this embodiment the second slide member 11 couples together the rearwardly extending legs 9 and is configured as the aforementioned block member.

In the preferred embodiment of FIG. 4, the second slide member 11 is mounted to the support member 6 in such a way as to make it removable and therefore easily replaceable. In the preferred embodiment, the rearwardly extending legs 9, disposed in the block member 14, slidably engage the second slide member 11 which is mounted to the support member 6 as shown in FIGS. 4 and 5. As with the first slide member 10, the second slide member 11 is preferably made out of acetal.

To provide an optimal sliding interface between the second slide member 11 and the block member 14, the block member 14 is preferably made out of nylon. The second slide member 11 and the block member 14 are configured as complementary wedge-shape members, illustrated in FIGS. 4 and 5, so as to ensure that maximum contact is maintained between the block member 14 and the second slide member 11 as the seat 4 and back 5 tilt rearwardly. In addition, the block member 14 has a forwardly extending flange 171. The flange 171 has a hole 173 and is mounted on a shaft 78 between the torsion springs 7 as shown in FIG. 4.

As a user tilts rearwardly, the center of gravity of the user moves rearwardly. Accordingly, the lever arms between the applied force of the user's weight and the reaction force at the rearwardly extending legs 9 of the torsion springs 7 and the reaction force at the second pivot members 102, located at the second axis of rotation 13, are increased proportionately. However, the increased force applied to the torsion springs 7 at the point of contact between the second slide member 11 and the rearwardly extending leg 9 of the torsion springs 7 is countered by an increased force applied upwardly by the rearwardly extending legs 9. The increased upward force is caused by a shortening of the lever arm between the point of contact and the horizontal axis of the torsion springs as the second slide member 11 disposed on the support member 6 slides forwardly on the block member 14. The axis of the springs 7 is approximately the same as the axis of the shaft 78 on which the springs 7 are disposed.

As shown in FIGS. 4 and 5, the sliding contact between the block member 14 and the second slide member 11 moves forward as the chair moves from the upright position to the reclined position. This forwardly sliding contact results from the springs' axis being positioned below the second axis of rotation 13. As the distance between the point of contact and the axis of the springs' rotation decreases, the lever arm of the torsion springs 7 is reduced and a correspondingly greater upward force is produced by the rearwardly extending legs 9. This increased upward force of the torsion springs 7 counters the aforementioned increased downward force produced by the user shifting his weight rearwardly. Thus, by offsetting the axis of the springs 7 from the second axis of rotation 13, a tilt control mechanism is provided which automatically adjusts for the increased moment arm, and resultant force, produced by a shift in the center of gravity as a user moves the chair between an upright position and a reclined position. As a result, the user does not feel a sag or decreased resistance as the chair is tilted into the reclined position.

As shown in FIGS. 4 and 6, the tilt control mechanism also has a tilt limiter device 15. The tilt limiter device 15 limits the upward tilting of the back 5. The tilt limiter device 15 has a stop member 16 depending downwardly from the support member 6 of the back 5, and a catch member 17 disposed on the tilt control housing 3. The stop member 16 is adapted to engage the catch member 17 when the torsion spring 7 biases the stop member 16 against the catch member 17 by way of the second slide member 11 and support member 6, thereby preventing the back 5 from rotating past the upright position. In the preferred embodiment, the stop member 16 is configured as a hook. In an alternative embodiment, the stop member can depend downwardly from the seat. In such an embodiment, the seat is prevented from rotating past an upright position. Because the torsion spring biases the support member upwardly against the seat, the back is also prevented from rotating past the upright position. In yet another embodiment, the tilt limiter device can be adapted to interconnect the seat and back, whereby the relative motion of the seat and back causes the tilt limiter device to arrest the chair at an upright position.

Figure 7:
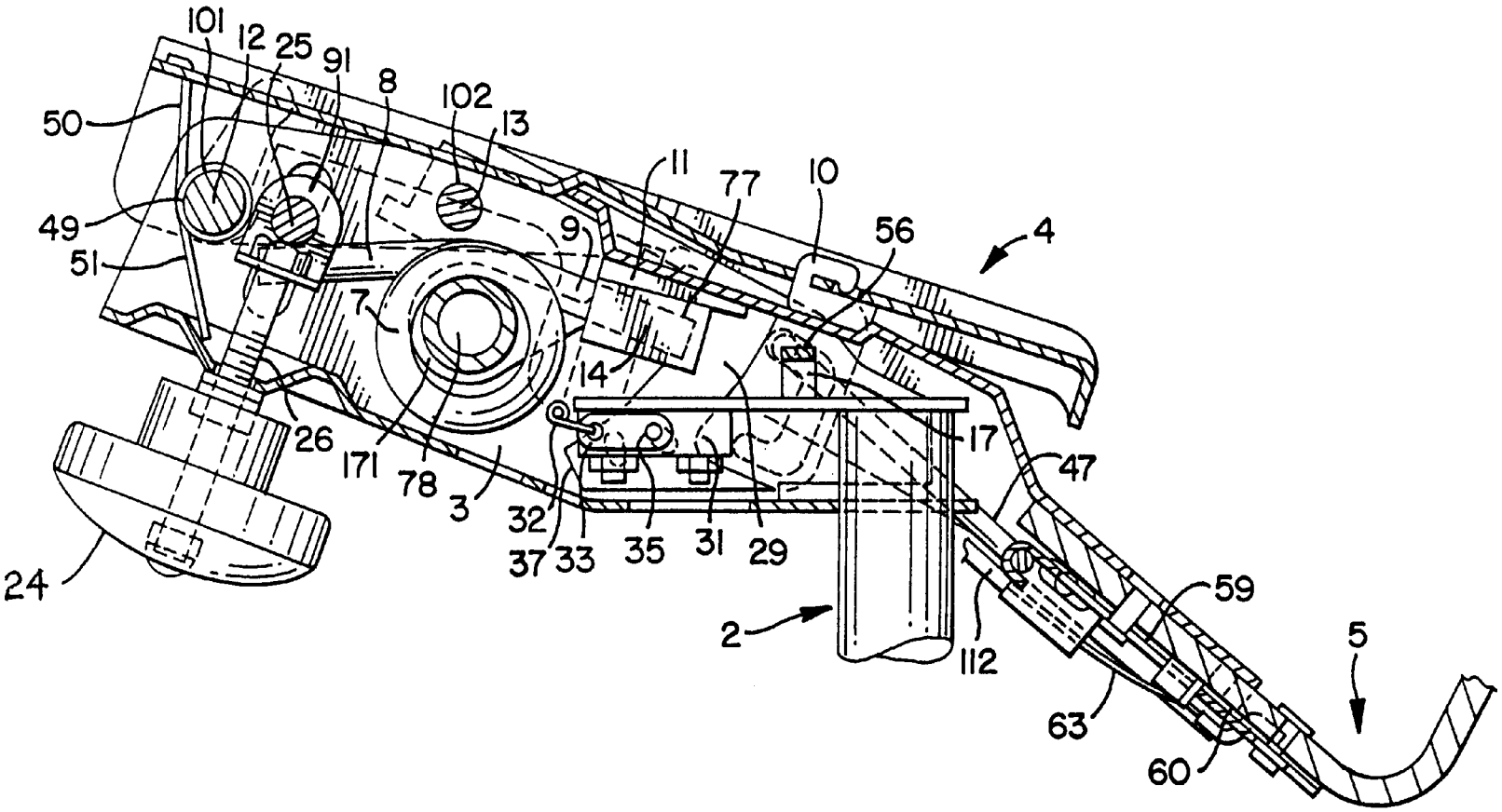
FIG. 7 is a cross-sectional view of the tilt control mechanism similar to FIG. 6 except that the chair is located in a reclined position.
Figure 8:
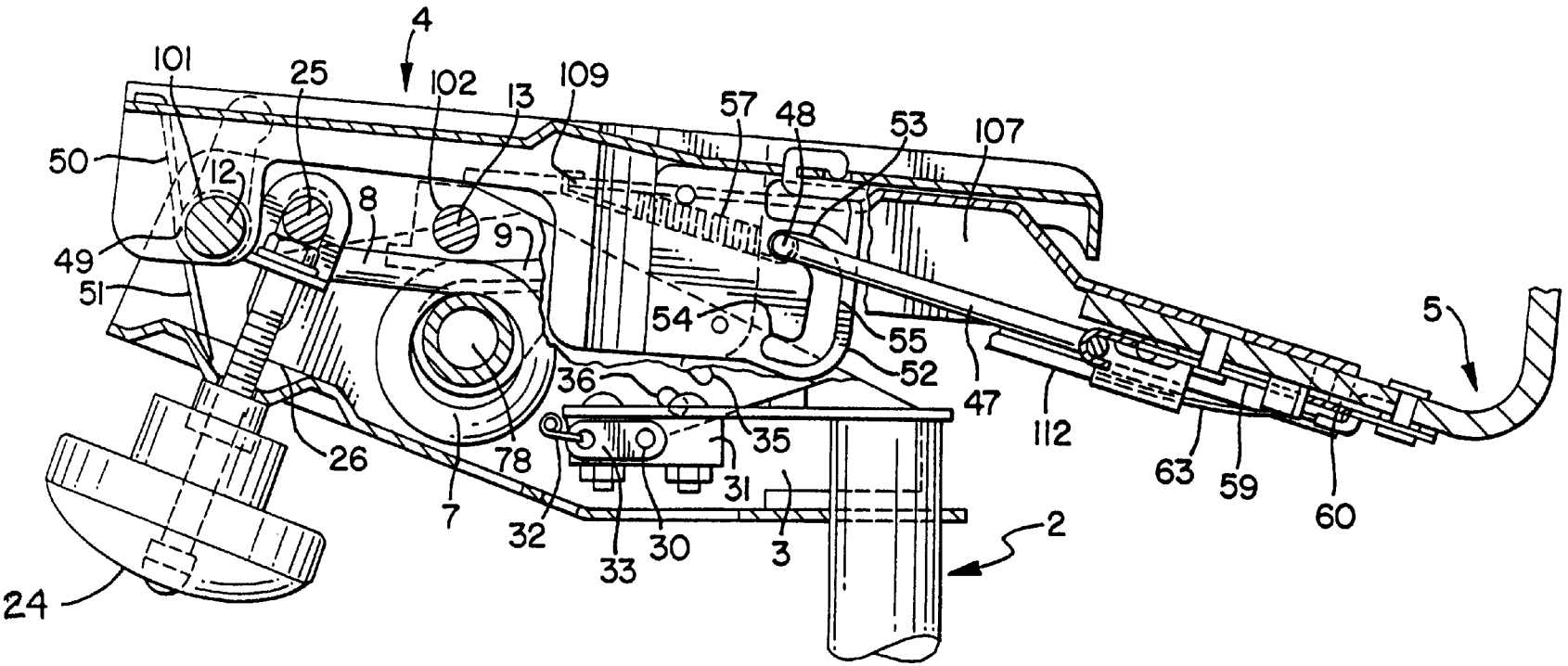
FIG. 8 is a cross-sectional view of the tilt control mechanism taken along line 8—8 of FIG. 2 with the chair located in an upright position.
Figure 9:
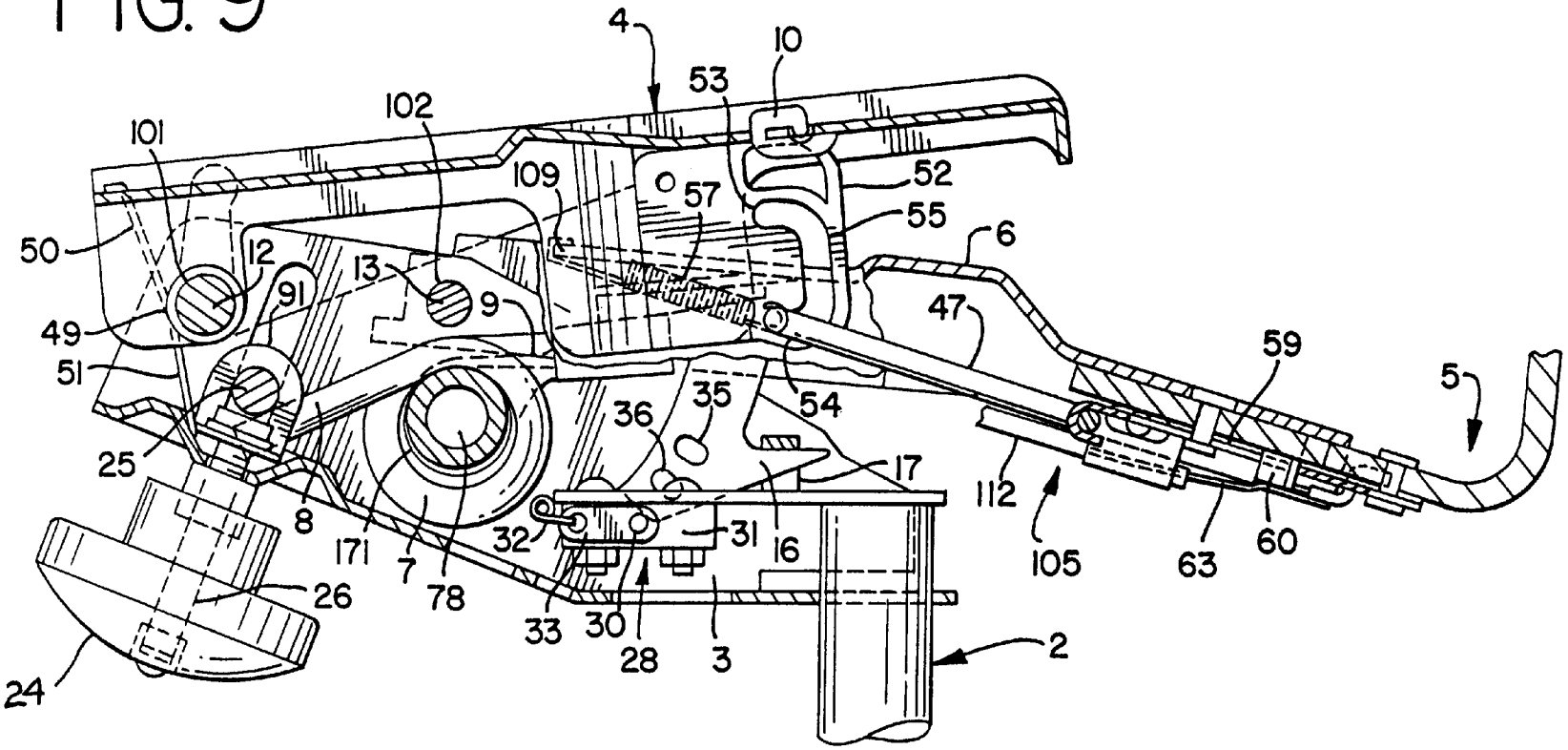
FIG. 9 is a cross-sectional view of the tilt control mechanism similar to FIG. 8 except that the seat is located in a forward position and the back is locked in an upright position.

The tilt control mechanism described in the foregoing embodiments operates in several different ways. For the purpose of illustration, the operation of the chair 1 will be described in terms of the various sitting positions that the preferred embodiment of FIGS. 6–10 may accommodate. For example, the chair 1 assumes an upright position when unoccupied or when a user is sitting in an upright position, as shown in FIGS. 6 and 8. When in this position, the seat is positioned at an angle $\alpha$ and the back is positioned at an angle $\beta$, as illustrated in the FIG. 15 schematic. The chair 1 can also be reclined, or assume a reclined position, as shown in FIG. 7. When in this position, the seat is positioned at an angle $\alpha 1$ and the back is positioned at an angle $\beta 1$. Alternatively, the seat 4 can be positioned in a forward tilt position as shown in FIG. 9. In a forward tilt position, the seat 4 rotates forwardly while the back 5 is maintained between the upright and reclined positions. As shown in FIG. 15, the seat 4 is positioned at an angle $\alpha 2$. Preferably, the chair can accommodate any number of positions not specifically identified and interspersed between the aforementioned positions.

When the chair is in the upright position, as shown in FIGS. 4, 6 and 8, the first slide members 10 engage the support member 6. The second slide member 11, preferably configured as a wedge shaped member, slidably engages the wedge shaped block member 14, which couples the torsion spring end portions 77. The torsion spring 7 exerts an upward force against the second slide member 11, thereby supporting the support member 6 and the seat 4. The torsion spring 7 also biases the stop member 16 against the catch member 17. Because the tilt limiter device 15 prevents the back 5 from being tilted forwardly and upwardly past the point where the stop member 16 engages the catch member 17, the back 5 and seat 4 are biased into the upright position.

When a user occupies the chair 1 in an upright position, as shown in FIGS. 4, 6, and 8, they are supported by the seat 4. The seat 4, in turn, is supported by the tilt control housing 3 at the point of pivotal attachment and by the first slide member 10 slidably engaging the support member 6 of the back 5. The downward force applied by the first slide member 10 to the support member 6 causes the second slide member 11 to slidably engage the block member 14 coupling the end portions 77 of the rearwardly extending legs 9 of the torsion spring 7. Thus, the user's weight is carried and resisted by the torsion spring 7 by way of the seat 5, the first slide member 10, the support member 6 and the second slide member 11.

When a user reclines in the chair 1 as shown in FIGS. 5 and 7, the seat 4 is supported by the support member 6 by way of the first slide members 7, which slidably engage the support member 6. When reclining, the first slide member 10 slides along the support member 6 while the second slide member 11, mounted on the support member 6, simultaneously slides along the block member 14 coupling the end portions 77 of the rearwardly extending legs 9 of the torsion spring 7. As the seat 4 moves downwardly, the back 5 is caused to move downwardly and rearwardly about its axis, whereby the user's feet are less likely to be lifted off of the floor and a more comfortable seating arrangement is maintained. As the seat 4 and back 5 are rotated about the first and second horizontal axes 12 and 13, the stop member 16 is released or disengaged from the catch member 17.

Figure 10:
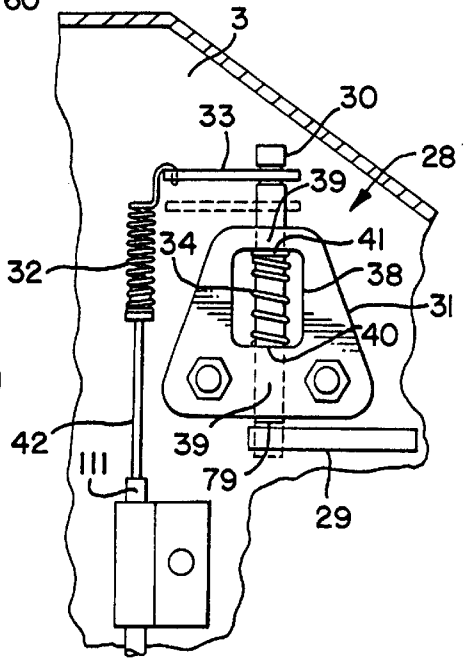
FIG. 10 is a partial bottom view of the tilt control mechanism taken along line 10—10 of FIG. 6.

As shown in the preferred embodiment of FIGS. 6 and 10, a tilt lock device 28 is provided to lock the back 5 into a plurality of positions, including the upright position and the reclined position. When locked, the user can use the chair 1 in a fixed position without a corresponding tilting of the back 5 and seat 4. As shown in FIGS. 6 and 10, the tilt lock device 28 has a lock member 29, a guide member 31, a lock pin 30, an actuator spring 32, a disengagement spring 34 and an end bracket 33. The lock member 29 depends downwardly from the support member 6 and includes the stop member 16 in the preferred embodiment. As shown in FIG. 6, the stop member 16, configured as a hook, is adapted to engage the catch member 17 disposed on the tilt control housing 3.

The lock member 29 also has a plurality of openings and a bottom edge 37. In a preferred embodiment, the lock member 29 has an upper slot 35 and a lower slot 36 as shown in FIGS. 6 and 9. In other embodiments, the openings can be configured in a variety of different shapes. Moreover, the plurality can comprise a multitude of openings, corresponding to the desired number of fixed positions for the chair.

The guide member 31 has a cavity 38 and a guide hole 39. The lock pin 30 is received in the guide hole 39 and extends through the cavity 38 as shown in FIG. 10. The disengagement spring 34 is disposed on a portion of the lock pin 30 which extends through the cavity 38. A lock washer 41 is mounted on the portion of the lock pin 30 located inside the cavity 38 in order to retain the lock pin 30 in the guide member 31 and to capture the disengagement spring 34 between the lock washer 41 and a bearing wall 40 defining one side of the cavity 38. The guide member 31 is mounted to the tilt control housing 3 adjacent to the lock member 29 and is oriented such that the lock pin 30 is positioned substantially perpendicular to the lock member 29.

A tilt lock cable 42 is attached at one end to a handle 43 which includes a housing 151 and a bracket 153. The handle 43 is slidably attached to the first pivot member 101 as shown in FIGS. 2 and 3. The first pivot member 101 extends outwardly from a front portion 44 of the seat at the first axis of rotation 12. The other end of the tilt lock cable 42 is attached to the actuator spring 32. The tilt lock cable 42 is disposed in a cable guide 111 having one end mounted to the tilt control housing 3 and the other end mounted to a forward portion of the seat 4 as shown in FIGS. 2 and 10. The actuator spring 32 interconnects the tilt lock cable 42 and the end bracket 33.

To actuate the tilt lock device 28, a user pulls the handle 43 outwardly to a first level. The tilt lock cable 42, connected to the handle 43, extends the actuator spring 32, which in turn applies a inward force to the end bracket 33. The end bracket 33 transfers the force to the lock pin 30 and biases the lock pin 30 against the lock member 29. For proper operation, the actuator spring 32 must exert a inward force on the lock pin 30, through the end bracket 33, that is greater than the outward force exerted on the lock pin 30 by the disengagement spring 34, because the disengagement spring 34 and actuator spring 32 simultaneously exert opposing forces on the lock pin 30. If the outward force exerted by the disengagement spring 34 were greater, the lock pin 30 could never be engaged with the lock member 29. Therefore, the disengagement spring 34 must be weaker than the actuator spring 32. When the handle 43 is returned to its original position, the actuator spring 32 is relaxed and the disengagement spring 34 biases the lock pin 30 away from the lock member 29.

The actuator spring 32, when actuated, biases the lock pin 30 against the lock member 29. As the user tilts forward or backward, an end of the pin 79 slides against the lock member 29. Eventually, the position of D the openings 35 and 36 corresponds to the position of the lock pin 30 whereby the lock pin 30 extends inwardly to engage the lock member 29 at one of the openings 35 and 36.

Alternatively, as shown in FIG. 6, the bottom edge 37 of the lock member 29 can slide past the lock pin 30, thereby permitting the lock pin 30 to be extended inwardly to engage the bottom edge 37. When so positioned, the actuator spring 33 biases the lock pin 30 past the bottom edge 37, thus securing the lock member 29 to the tilt control housing 3. When engaged with the lock member 29 at the bottom edge 37 or at one of the slots 35 and 36, the lock pin 30 locks the back 5 and support member 6 into a certain position. In the preferred embodiment shown in FIGS. 6–9, the back 5 and support member 6 can be locked into one of three positions. First, as shown in FIG. 7, the Dock pin 30 is received within the upper slot 35 of the lock member 29, thereby locking the back 5 and support member 6 into a reclined position. Similarly, the lock pin can be received in the lower slot, thereby locking the back and support member into an intermediate position. Finally, as shown in FIG. 6, the lock pin 30 can engage the bottom edge 37 of the lock member 29, thereby locking the back 5 and support member 6 into an upright position. In the upright position, the back 5 is prevented from moving downwardly and rearwardly by the lock pin 30, which engages the bottom edge 37 of the lock member 29. The back 5 is also prevented from moving upwardly by the stop member 16, which engages the catch member 17.

It should be noted that an unoccupied chair will not disengage from a locked reclined or intermediate position, even if the handle 43 is returned to its original position, because the torsion springs 7 exert an upward force on the support member 6. Accordingly, the lock member 16 exerts a corresponding upward force on the lock pin 30, which is received in one of the slots 35 and 36. That force, in turn, creates a corresponding lateral friction force between the lock member 29 and the lock pin 30, which prevents the lock pin 30 from disengaging from the lock member 29. The friction force exerted on the lock pin 30 by the lock member 29 is not overcome by the outward force exerted by the disengagement spring 34. Thus, the chair has a built in safety device which prevents the accidental springing forward of the back of an unoccupied chair when the handle 43 is disengaged. To the contrary, when a chair is occupied, the natural weight of the user counters the upward force of the torsion springs 7 and the corresponding upward force exerted by the lock member 29 on the lock pin 30 is greatly reduced or even eliminated. Accordingly, the resulting friction force applied to the lock pin 30 by the lock member 29 is also reduced or eliminated and the disengagement spring 34 is able to bias the lock pin 30 away from the lock member 29 when the handle is returned to its original position.

In a preferred embodiment, the seat 4 can also be positioned in a forward tilt position as shown in FIG. 9. As shown in FIG. 15, the seat 4 rotates upwardly through an angle a2 to reach the forward tilt position. In a preferred embodiment, m2 is about teni degrees. In this position, the first slide member 10 mounted on the seat 4 disengages from the support member 6 as the seat 4 pivots upwardly about the first horizontal axis 12. A front torsion spring 49, shown in FIGS. 2 and 9, biases the seat 4 upwardly. The spring 49 is disposed on the first pivot member 101. Alternatively, two springs can be disposed on the first pivot member. The front torsion spring 49 has a first leg 50 and a second leg 51. The first leg 50 is biased against a front portion of the seat 4. The second leg 51 is mounted to the tilt control housing 3. In a preferred embodiment, the back 5 is maintained in a locked position by the tilt lock device 28 when the seat 4 is positioned in a forward tilt position. However, the seat can be positioned in a forward tilt position without the back or support member being in a locked position. In such an embodiment, the seat is positioned in a forward tilt position, but can tilt rearwardly with the back. In the preferred embodiment, it should be understood that the back 5 and support member 6 can be locked in any one of the three locked positions, i.e., a reclined position, an intermediate position, or an upright position, when the seat 4 is tilted into a forward tilt position. For example, the support member 6 is locked into an upright position in FIG. 9. When the back is in a locked position, or unlocked and retained in an upright position by the tilt limiter device, the user is permitted to use the seat in a forward tilt position without having the back 5 simultaneously rotate upwardly and protrude into the user's back or otherwise interfere with the space occupied above the forwardly tilted seat 4.

In a preferred embodiment, the seat 4 can be locked or held in the forward tilt position by engaging a stop device. This permits the user to be supported by the seat 4 when it is secured in the forward tilt position.

Figure 16:
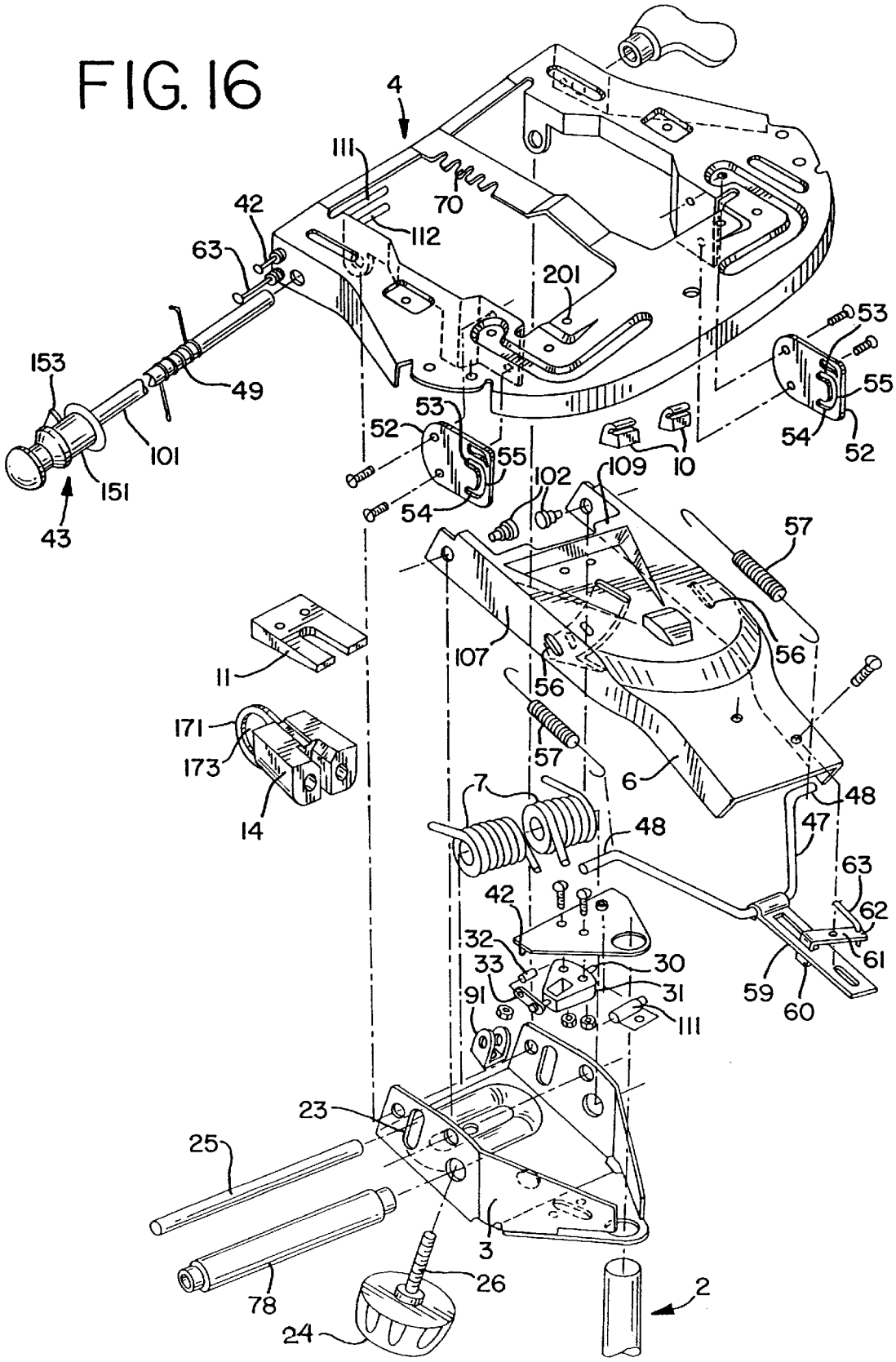
FIG. 16 is an exploded view of the tilt control mechanism.

The stop device operably engages the seat 4 and the tilt control housing 3 when the seat 4 is in a forward tilt position. The stop device includes the tilt lock device 28 and a seat lock device 105. The seat lock device 105 includes a tilt bracket 52 and a lock bar 47. In the preferred embodiment, the lock bar 47 comprises a rod. The tilt lock device 28 secures the back 5 to the tilt control housing 3 and the seat lock device 105 secures the seat 4 to the support member 6. As shown in FIG. 2, the lock bar 47 is preferably y-shaped and has a pair of arms 48. The tilt bracket 52 depends downwardly from the seat 4 and has a first slot 54, a second slot 53 and a channel 55 communicating with the slots as shown in FIGS. 8 and 9. The support member 6 has a support slot 56 positioned in a downwardly extending flange 107 as shown in FIG. 16. The arms 48 of the lock bar 47 are disposed in the support slot 56 and one of the openings of the tilt bracket 52. A pair of springs 57 bias the lock bar 47 forwardly into one of the openings of the tilt bracket 52. The springs 57 operably engage the lock bar and a forward edge 109 of the support member 6. Alternatively, compression springs can be used to bias the lock bar forwardly.

When the seat 4 is maintained between the upright and reclined position, the springs 57 bias the arms 48 of the lock bar 47 into the second slot 53 as shown in FIG. 8. The arms 48 are positioned in the support slot 56 and slidably engage the flange 107 of the back support member 6. The arms 48 are also positioned in the second slot 53 and slidably engage the tilt bracket 52, allowing the seat 4 and the back 5 to tilt synchronously, yet maintaining a proximate relationship between the seat 4 and back 5. This prevents the seat 4 from popping forward if the user applies a force to a point of the seat 4 forward of its horizontal axis of rotation 12. In addition, the lock bar 47 prevents the seat 4 from rotating forwardly due to the upward force applied by the front torsion spring 49. Because the seat 4 is secured to the support member 6, the seat 4 can only rotate upwardly with the back 5. However, since the tilt limiter device 15 prevents the back 5 from tilting upwardly past the upright position, the seat 4 is also prevented from doing so.

Figure 2A:
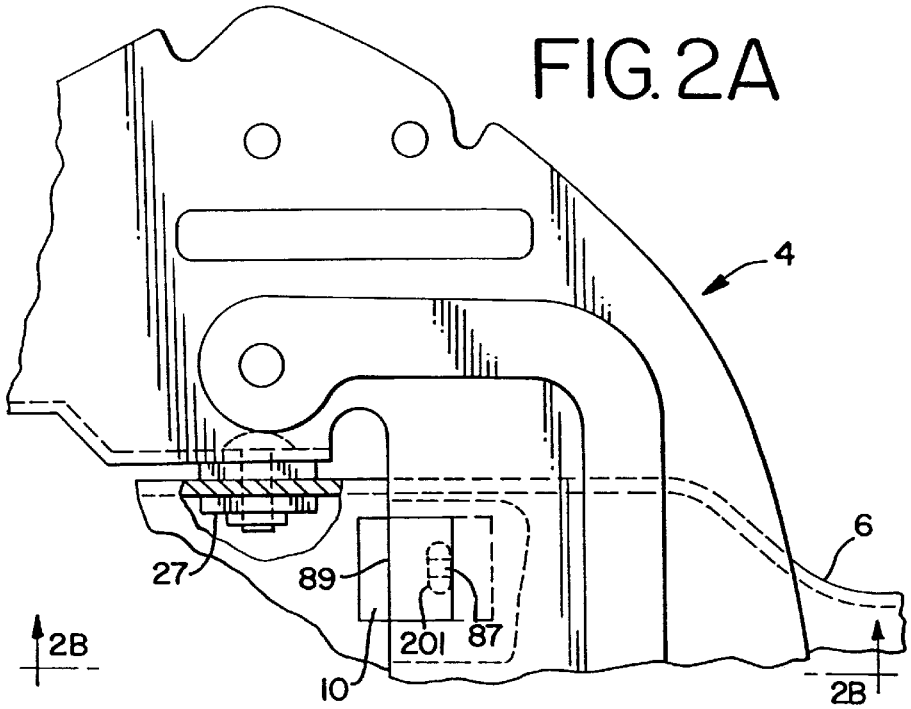
FIG. 2A is a partial top view similar to FIG. 2 except that a coupling bracket is shown instead of the seat lock device.
Figure 2B:
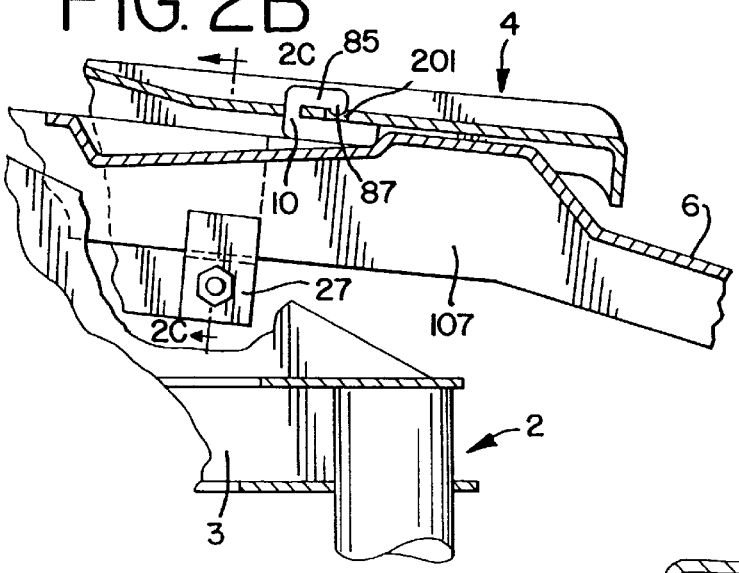
FIG. 2B is a partial side view taken along line 2B—2B of FIG. 2A.
Figure 2C:
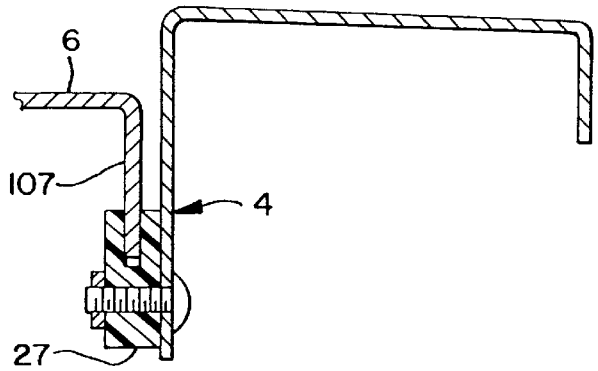
FIG. 2C is a sectional view taken along line 2C—2C of FIG. 2B.

As shown in FIGS. 2A–2C, a coupling block 27 can also be employed to slidably connect the seat 4 to the support member 6 instead of the lock bar 47. In this embodiment, which does not employ a seat lock device, the seat 4 cannot be rotated into a forward tilt position. The coupling block 27 is mounted to the seat 4 as shown in FIGS. 2A–2C and slidably engages the flange 107 depending downwardly from the underside of the support member 6. The coupling block 27 allows the seat 4 and the back to tilt synchronously, yet maintains the seat 4 in a proximate relationship to the back. As previously explained with the preferred embodiment, which employs the lock bar to interconnect the seat and back, the coupling block 27 prevents the seat 4 from popping forward when a force is applied forward of the seat's pivotal attachment 12. Rather, the seat's 4 upward motion is limited by the motion of the support member 6 due to the coupling block 27. Preferably, the coupling block 27 is made out of nylon.

When a user wishes to use the seat 4 in a forward tilt position, an actuator device is employed. The actuator device includes a seat lock cable 63 attached to the handle 43, a slide bracket 59 and a lever arm 60 attached to the seat lock cable 63 as shown in FIG. 2. The seat lock cable 63 is disposed in a cable guide 112 which is mounted to the rear portion of the support member 6 and to a forward portion of the seat 4 as shown in FIGS. 2 and 16. The lever arm 60 is rotatably mounted to a rear portion of the support member 6 and has a first end 61 engaging a slot in the slide bracket 59 and a second end 62 connected to the seat lock cable 63. The slide bracket 59 is slidably attached to the support member 6 with two pins and has a hook end connected to the lock bar 47.

To actuate the actuator device, the handle 43, which is slidably attached to the first pivot member 101, is pulled outwardly, retracting the seat lock cable 63 and rotating the lever arm 60. The rotation of the lever arm 60 causes the slide bracket 59 to translate rearwardly. The translation of the slide bracket 59 disengages the lock bar 47 from the second slot 53 in the side bracket 52 and translates the lock bar 47 rearwardly in the support slot 56. As the lock bar 47 disengages from the second slot 53, the lock bar 47 moves into the channel 55 and the torsion springs 49 bias the seat 4 upwardly until it reaches a forward tilt position. If the handle 43 is released, the springs 57 bias the lock bar 47 into the first slot 54, translating the lock bar 47 forwardly in the first slot 54 and the support slot 56. It is recognized that a release of the handle 43 at any point in the upward rotation will cause the lock bar 47 to move forward into the first slot 54 when the seat reaches the forward tilt position due to the force exerted by the springs 57. Once positioned in the first slot 54, the lock bar 47 slidably engages the tilt bracket 52 and support member 6, securing the seat 4 to the support member 6 and locking the seat 4 in the forward tilt position.

To disengage the seat lock device 105, the user merely pulls the handle 43, which causes the actuator device to translate the lock bar 47 rearwardly from the first slot 54 into the channel 55 and translates the lock bar 47 rearwardly in the support slot 56 in the support member 6. Once the lock bar 47 is in the channel 55, a downward force on the seat 4 causes the seat 4 to return to an upright position as the lock bar 47 translates upwardly in the cannel 55. Once the seat 4 reaches the upright position, the springs 57 pull the lock bar 47 forwardly from the channel 55 into the second slot 53. The lock bar 47 secures the upward tilt bracket 52 to the support member 6.

The same handle 43 is used to activate both the tilt lock device 28 and the actuator device 58 in the preferred embodiment. This serves two purposes. First, a single handle provides improved aesthetics by avoiding a cluttering of the underside of the chair. Second, a single handle ensures that the preferred embodiment stop device is properly activated. The preferred stop device includes both the tilt lock device 28 and the seat lock device 105. The stop device ensures that the seat 4 is secured in a forward tilt position, or fixed to the tilt control housing 3 in some manner. Preferably, the back 5 is first secured to the tilt control housing 3 and the seat 4 is then fixed to the back 5. The tilt lock device 28 performs the first function, and the seat lock device 105 performs the second function.

In operation, the back support member 6 is first fixed to the tilt control housing 3 using the tilt lock device. The actuator device is then employed to release the lock bar 47, thereby permitting the seat 4 to tilt upwardly into a forward tilt position where it is locked in position by the seat lock device 105. Therefore, the tilt lock device 28 and the seat lock device 105 must be employed in a specific order. Using a single handle ensures that this sequence is performed in the correct order. For example, an outward pull of the handle 43 will first engage the tilt lock device 28 as previously described. As shown in FIGS. 2 and 16, an end of the seat lock cable 63 extends past the bracket 153 while the tilt lock cable 42 is attached to the bracket 153. Therefore, an outward pull on the handle 43 pulls the tilt lock cable 42 but does not pull the seat lock cable 63. A further extension of the handle 43, however, pulls the tilt lock cable 42 until the bracket 153 engages the end of the seat lock cable 63, thereby causing the actuator device to release the seat 4 and permitting it to rotate into a forward tilt position. When the seat 4 is positioned in the forward tilt position, the handle 43 is released and the lock bar 47 is biased into the first slot 54 by the springs 57, thus securing the seat 4 to the support member 6.

Figure 11:
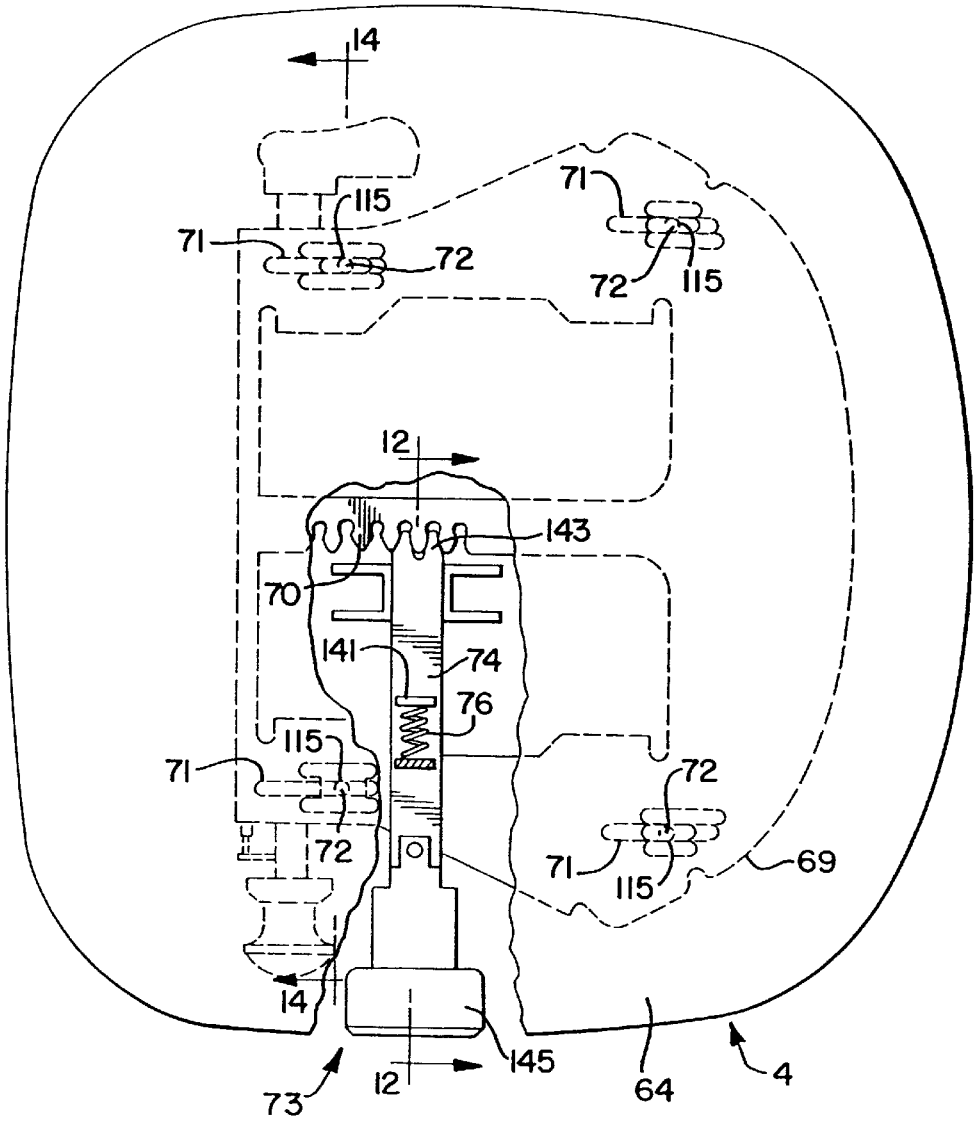
FIG. 11 is a top view of the seat with a seat adjustment device applied thereto.
Figure 14:
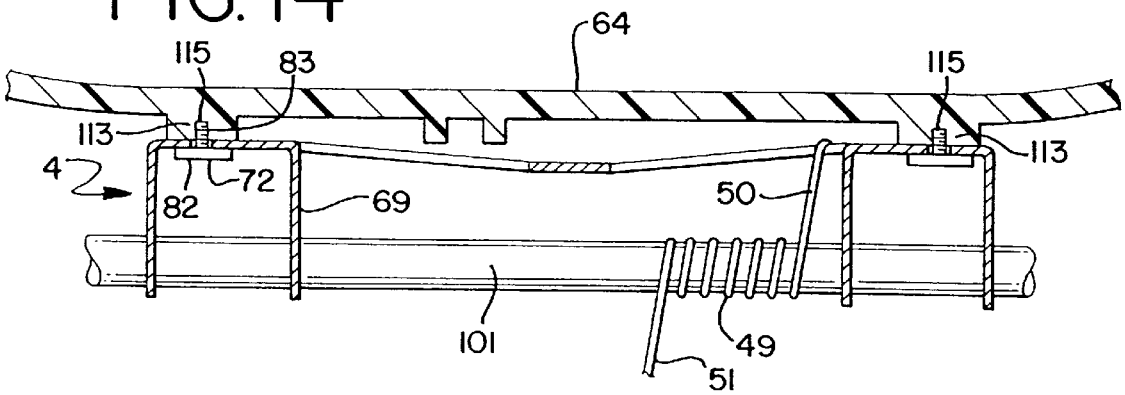
FIG. 14 is a cross-sectional view of the seat taken along line 14—14 of FIG. 11.

In an exemplary embodiment, shown in FIGS. 11 and 14, the seat 4 includes a shell 64, a seat bracket 69, and a seat adjustment device 73. The seat bracket 69 has four elongated openings 71 and a plurality of teeth 70. The shell 64 has four mounting pads 113 and a mounting hole 115 positioned in each pad 113. The shell 64 is slidably mounted to the seat bracket 69 by installing four fasteners 72 in the elongated openings 71 as shown in FIG. 14. The fasteners 72 engage the shell at the mounting holes 115. Each fastener includes a cap 82 and a shaft 83. The fasteners secure the shell 64 to the seat bracket 69 while simultaneously permitting the shell to translate forwardly and rearwardly with respect to the seat bracket 69. During translation, the shaft 83 of the fastener slides in the elongated opening 71 while the cap 82 secures the shell 64 to the seat bracket 69.

Figure 12:
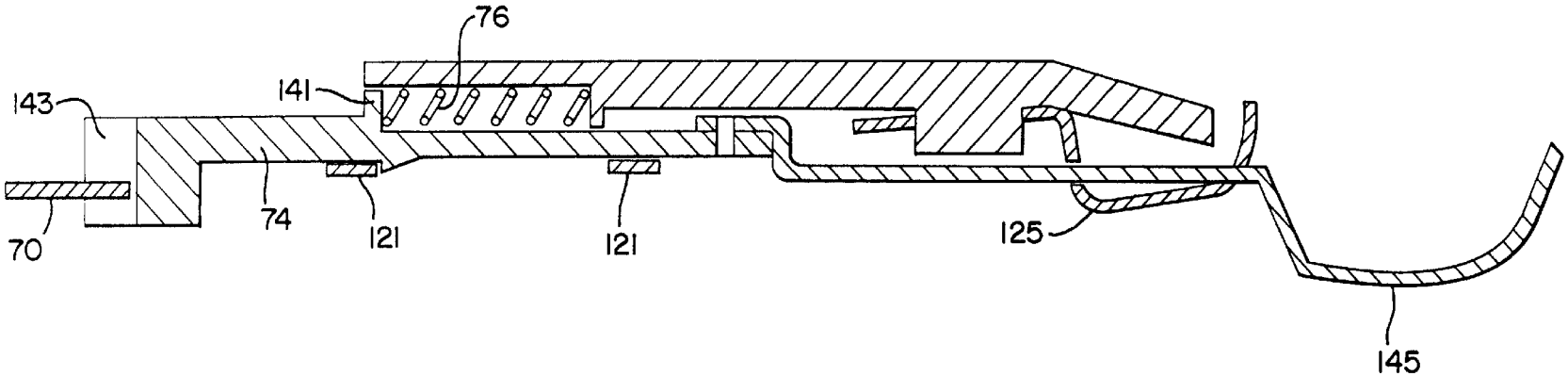
FIG. 12 is a cross-sectional view of the seat adjustment device taken along line 12—12 of FIG. 11 with the lever located in an engaged position.
Figure 13:
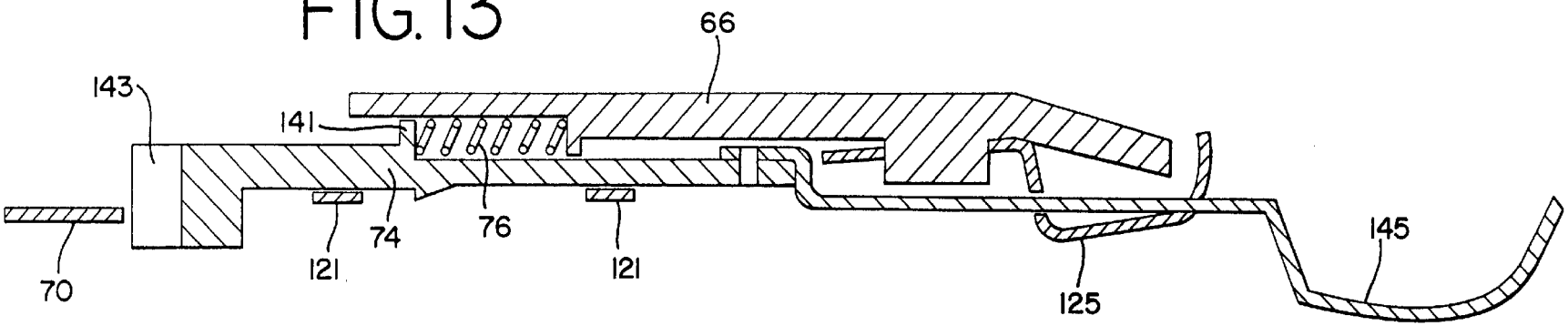
FIG. 13 is a cross-sectional view of the seat adjustment device similar to FIG. 12 except that the lever is located in a disengaged position.

The seat adjustment device includes a lever 74 and a spring 76. The lever 74 slidably engages a housing portion 66 of the shell 64, which includes two straps 121 and an outer shell 125. The spring 76. is disposed in the housing 66 and operably engages a bearing member 141 extending upwardly from the lever 74. The spring 76 also operably engages the housing 66, as shown in FIGS. 12 and 13. In an exemplary embodiment, shown in FIGS. 12 and 13, the spring is a compression spring biasing an end portion 143 of the lever 74 against the teeth 70. It is understood that other embodiments could use a tension spring. To actuate the seat adjustment device, the user pulls a handle 145, that extends outwardly from the lever 74, away from the teeth 70, thereby disengaging the end portion 143 of the lever 74. The user then translates the shell 64 in a forward or rearward direction until the desired seat depth position is obtained. The lever 74 is then released. When released, the spring 76 biases the end portion 143 of the lever 74 against the teeth 70 and into an engaged position, thereby preventing the shell 64 from being translated in a forward or rearward direction.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A chair comprising:

a base;

a support bracket supported above said base, said support bracket comprising a rack;

a backrest connected to said base;

a seat slidably mounted to said support bracket; and a lever slidably mounted to said seat, said lever moveable between an engaged position wherein said lever engages said rack and a disengaged position wherein said lever is disengaged from said rack, wherein said seat is slideable in a forward and rearward direction relative to said backrest when said lever is in said disengaged position.

2. The chair of claim 1 wherein said base comprises a housing and wherein said support bracket is pivotally mounted to said housing.

3. The chair of claim 1 wherein said seat comprises a shell slidably mounted to said support bracket, wherein said lever is slidably mounted to said shell.

4. The chair of claim 1 wherein said support bracket has at least one elongated opening, and wherein said seat comprises at least one fastener depending therefrom, said at least one fastener disposed in said at least one elongated opening wherein said at least one fastener secures said seat to said support bracket while permitting slidable movement therebetween along the extent of the elongated opening.

5. The chair of claim 4 wherein said support bracket has four elongated openings and wherein seat comprises four fasteners engaging said elongated openings respectively so as to permit slidable movement between the support bracket and the seat.

6. The chair of claim 1 further comprising a spring disposed in said seat and engaging said lever so as to bias said lever toward said rack and into said engaged position.

7. The chair of claim 1 wherein said seat is moveable in a forward and rearward direction relative to said support bracket and said backrest and wherein said lever is laterally moveable along a path substantially perpendicular to the forward and rearward movement of the seat relative to the support bracket and the backrest.

8. The chair of claim 1 wherein said backrest is pivotally connected to said base.

9. The chair of claim 8 wherein said base comprises a housing, wherein said backrest is pivotally connected to said housing.

10. The chair of claim 1 wherein said base comprises a housing, a support column having a lower portion and an upper portion, wherein said upper portion is connected to said housing, at least one support arm extending laterally from said lower portion of said support column and at least one wheel connected to said at least one laterally extending support arm.

11. A chair comprising:

a base;

a backrest connected to said base;

a seat comprising a shell slidably mounted to a support bracket, wherein said support bracket is supported above said base, said support bracket comprising a plurality of teeth;

a lever moveably mounted to said shell, said lever moveable between an engaged position wherein said lever engages at least one of said plurality of teeth and a disengaged position wherein said lever is disengaged from said plurality of teeth, wherein said seat is slideable in a forward and rearward direction relative to said backrest when said lever is in said disengaged position; and a spring biasing said lever into said engaged position.

12. The chair of claim 11 wherein said base comprises a housing and wherein said support bracket is pivotally mounted to said housing.

13. The chair of claim 11 wherein said support bracket has at least one elongated opening, and wherein said shell comprises at least one fastener depending therefrom, said at least one fastener disposed in said at least one elongated opening wherein said at least one fastener secures said shell to said support bracket while permitting slidable movement therebetween along the extent of the elongated opening.

14. The chair of claim 13 wherein said support bracket has four elongated openings and wherein seat comprises four fasteners engaging said elongated openings respectively so as to permit slidable movement between the support bracket and the shell.

15. The chair of claim 11 wherein said seat is moveable in a forward and rearward direction relative to said support bracket and said backrest and wherein said lever is laterally moveable along a path substantially perpendicular to the forward and rearward movement of the seat relative to the support bracket and the backrest.

16. A chair comprising:

a base;

a backrest connected to said base;

a seat;

means mounted to said base for slidably supporting said seat; and means mounted on said seat for engaging said support means so as to prevent slidable movement between said seat and said support means, said engagement means moveable between an engaged position wherein said seat is prevented from moving relative to said support means and a disengaged position wherein said seat is moveable relative to said support means and to said backrest.

17. The chair of claim 16 wherein said engagement means comprises a lever.

18. The chair of claim 16 further comprising a means for biasing said engagement means into engagement with said support means.

19. The chair of claim l8 wherein said biasing means comprises a spring.

20. The chair of claim 11 wherein said backrest is pivotally connected to said base, said backrest pivotable between at least a reclined position and an upright position.

21. The chair of claim 20 wherein said shell is pivotally supported by said base, said seat pivotable between at least a reclined position and an upright position.

22. The chair of claim 21 wherein said seat and said backrest are synchronously tiltable relative to each other.

23. A chair comprising:

a base;

a backrest supported by said base;

a seat support comprising a rack, wherein said seat support is supported by said base;

a seat slidably mounted to said seat support;

a latch member moveably mounted on said seat, said latch member moveable between an engaged position wherein said latch member engages said rack and a disengaged position wherein said latch member is disengaged from said rack, wherein said seat is moveable in a forward and rearward direction relative to said backrest when said latch member is in the disengaged position.

24. The chair of claim 23 further comprising a spring biasing said latch member into said engaged position.

25. The chair of claim 24 wherein said spring is disposed between said scat and said latch member.

26. The chair of claim 23 wherein said seat is moveable in a forward and rearward direction relative to said seat support.

27. The chair of claim 23 wherein said seat comprises a front and a rear, and wherein said rack is formed by a plurality of openings spaced along a portion of said seat support in a direction running from the front to the rear of the seat, wherein each of said plurality of openings is dimensioned to receive an end portion of said latch member.

28. The chair of claim 27 wherein said rack comprises a plurality of teeth defining said plurality of openings therebetween.

29. The chair of claim 23 wherein said seat further comprises a shell.

30. The chair of claim 23 wherein said base comprises a housing, wherein said seat support is mounted to said housing.

31. The chair of claim 30 wherein said seat support is moveably mounted to said housing.

32. The chair of claim 31 wherein said seat support is pivotally mounted to said housing.

33. The chair of claim 30 wherein said backrest is pivotally supported by said housing, said backrest pivotable between at least a reclined position and an upright position.

34. The chair of claim 33 wherein said seat support is pivotally supported by said housing, said seat pivotable between at least a reclined position and an upright position.

35. The chair of claim 34 wherein said seat support and said backrest are synchronously tiltably supported by said housing.

36. The chair of claim 23 wherein said base comprises a housing, a support column having a lower portion and an upper portion, wherein said upper portion is connected to said housing, at least one support arm extending laterally from said lower portion of said support column and at least one wheel connected to said at least one laterally extending support arm.

37. A chair comprising:

a housing;

a backrest supported by said housing;

a seat support having a plurality of openings spaced along a portion thereof, wherein said seat support is supported by said housing;

a seat slidably mounted to said seat support, wherein said seat is slideable in a forward and rearward direction relative to said backrest;

a latch member moveably mounted to said seat and having an engagement portion shaped to be selectively received in at least one of said plurality of openings in said seat support, said latch member moveable between an engaged position wherein said engagement portion of said latch member is received in said at least one of said plurality of openings and a disengaged position wherein said engagement portion is removed from said at least one of said plurality of openings, wherein said seat can be moved relative to said said backrest when said latch member is in the disengaged position.

38. The chair of claim 37 further comprising a base and a housing mounted to said base, wherein said seat support is moveably mounted to said housing.

39. The chair of claim 38 wherein said seat support is pivotally mounted to said housing.

40. The chair of claim 37 further comprising a spring biasing said latch member into said engaged position.

41. The chair of claim 40 wherein said spring is disposed between said seat and said latch member.

42. The chair of claim 37 wherein said seat is slidable in a forward and rearward direction relative to said seat support.

43. The chair of claim 37 wherein said seat further comprises a shell slidably mounted to said seat support.

44. The chair of claim 37 wherein said seat support comprises a rack defining said plurality of openings.

45. The chair of claim 44 wherein said rack comprises a plurality of teeth defining said plurality of openings therebetween.

46. The chair of claim 37 wherein said backrest is pivotally supported by said housing, said backrest pivotable between at least a reclined position and an upright position.

47. The chair of claim 46 wherein said scat support is pivotally supported by said housing, said scat pivotable between at least a reclined position and an upright position.

48. The chair of claim 47 wherein said seat support and said backrest are synchronously tiltably supported by said housing.

49. The chair of claim 37 wherein said base comprises a housing, a support column having a lower portion and an upper portion, wherein said upper portion is connected to said housing, at least one support arm extending laterally from said lower portion of said support column and at least one wheel connected to said at least one laterally extending support arm.

50. A chair comprising:

a base;

a seat support comprising a rack, wherein said seat support is pivotally connected to said base, said seat support pivotable between at least a reclined position and an upright position;

a seat slidably mounted to said seat support;

a lever member moveably mounted on said seat, said lever member moveable between an engaged position wherein said lever member engages said rack and a disengaged position wherein said lever member is disengaged from said rack, wherein said seat is moveable in a forward and rearward direction relative to said seat support when said lever member is in the disengaged position.

51. The chair of claim 50 further comprising a backrest pivotably connected to said base.

52. The chair of claim 51 wherein said base comprises a housing, and wherein said backrest and said seat support are pivotably connected to said housing.

53. The chair of claim 50 further comprising a spring biasing said lever member into said engaged position.

54. The chair of claim 50 wherein said seat comprises a front and a rear, and wherein said rack is formed by a plurality of openings spaced along a portion of said seat support in a direction running from the front to the rear of the seat, wherein each of said plurality of openings is dimensioned to receive an end portion of said lever member.

55. A chair comprising:

a base;

a seat support having a plurality of openings spaced along a portion thereof, wherein said seat support is pivotably connected to said base;

a seat slidably mounted to said seat support, wherein said seat is slideable in a forward and rearward direction relative to said seat support;

a lever member moveably mounted to said seat and having an engagement portion shaped to be selectively received in at least one of said plurality of openings in said seat support, said lever member moveable between an engaged position wherein said engagement portion of said lever member is received in said at least one of said plurality of openings and a disengaged position wherein said engagement portion is removed from said at least one of said plurality of openings, wherein said seat can be moved relative to said seat support when said lever member is in the disengaged position.

56. The chair of claim 55 further comprising a backrest pivotably connected to said base.

57. The chair of claim 56 wherein said base comprises a housing, and wherein said backrest and said seat support are pivotably connected to said housing.

58. The chair of claim 55 further comprising a spring biasing said lever member into said engaged position.

59. A chair comprising:

a base;

a backrest supported by said base;

a seat bracket comprising a rack, wherein said seat bracket is supported by said base;

a seat slidably mounted to said seat bracket, wherein said seat is slideable in a forward and rearward direction relative to said backrest;

a lever moveably mounted on said seat, said lever moveable between an engaged position wherein said lever member engages said rack and a disengaged position wherein said lever member is disengaged from said rack, wherein said seat is moveable in a forward and rearward direction relative to said backrest when said lever is in the disengaged position; and a spring biasing said lever into said engaged position.

60. The chair of claim 59 wherein said spring is disposed between said seat and said lever.

61. The chair of claim 59 wherein said backrest is pivotally connected to said base.

62. The chair of claim 59 wherein said seat bracket is pivotably supported by said base, wherein said seat bracket is pivotable between at least a reclined position and an upright position.

63. The chair of claim 62 wherein said base comprises a housing, and wherein said seat bracket is directly pivotably connected to said housing.

64. The chair of claim 59 wherein said rack is defined by a plurality of openings and wherein said lever comprises a nose portion selectively received in at least one of said plurality of openings when said lever is in the engaged position.

65. The chair of claim 64 wherein said rack comprises a plurality of teeth defining said openings.

66. The chair of claim 59 wherein said spring comprises a compression spring.

67. The chair of claim 59 further comprising a handle operably connected to said lever.

68. The chair of claim 59 wherein said base comprises a housing, a support column having a lower portion and an upper portion, wherein said upper portion is connected to said housing, at least one support arm extending laterally from said lower portion of said support column and at least one wheel connected to said at least one laterally extending support arm.

* * * * *

UNITED STATES PATENT AND TRADEMARK OFFICE

CERTIFICATE OF CORRECTION

PATENT NO. : 6,273,506 B1 
DATED : August 14, 2001
INVENTOR(S) : Tom S. Niergarth et al.

It is certified that error appears in the above-identified patent and that said Letters Patent is hereby corrected as shown below:

Column 15,
Line 27, delete “scat” and substitute -- seat -- in its place.

Column 16,
Line 16, delete “said” second occurrence.
Lines 40 and 41, delete “scat” and substitute -- seat -- in its place.

Signed and Sealed this

Sixteenth Day of July, 2002

*Attest:*

*Attesting Officer*

JAMES E. ROGAN
*Director of the United States Patent and Trademark Office*